US005967053A

United States Patent [19]

Toussaint et al.

[11] Patent Number: 5,967,053

[45] Date of Patent: Oct. 19, 1999

[54] SIDEFRAMES FOR RAILWAY TRUCKS

[75] Inventors: Brian A. Toussaint, Lisle; Thomas R. Callahan, Maryville; Anthony J. Bauer; Edward R. Hanson, both of Edwardsville; Charles Moehling, Arlington Heights, all of Ill.; Ronald R. Evers, Alliance, Ohio

[73] Assignee: AMSTED Industries Incorporated, Chicago, Ill.

[21] Appl. No.: 09/058,680

[22] Filed: Apr. 10, 1998

Related U.S. Application Data

[62] Division of application No. 08/780,546, Jan. 8, 1997, Pat. No. 5,752,564.

[51] Int. Cl.[6] ..... B61F 3/00

[52] U.S. Cl. ..... 105/206.1; 105/200

[58] Field of Search ..... 105/206.1, 182.1, 105/200, 213

[56] References Cited

U.S. PATENT DOCUMENTS

| | | | |
|---|---|---|---|
| 3,687,086 | 8/1972 | Barber | 105/206.1 |
| 5,410,968 | 5/1995 | Hawthorne et al. | 105/206.1 |
| 5,481,986 | 1/1996 | Spencer et al. | 105/206.1 |

FOREIGN PATENT DOCUMENTS

| | | |
|---|---|---|
| 0445355A2 | 9/1991 | European Pat. Off. . |
| 0486463A2 | 5/1992 | European Pat. Off. . |
| 62-013240 | 1/1987 | Japan . |

*Primary Examiner*—Robert J. Oberleitner
*Assistant Examiner*—Robert J. McCarry, Jr.
*Attorney, Agent, or Firm*—Edward J. Brosius; F. S. Gregorczyk; Stephen J. Manich

[57] ABSTRACT

Improvements in cast metal sideframes for railway trucks are disclosed, along with improvements in the processes of casting such products and the cores used in the casting process. A radial draft is provided on the casting surrounding a bolt hole at a core parting or joint line so that nuts and washers may be evenly loaded. The radial draft is formed on the sideframe column, on the side opposite the side to which a wear plate is mounted. The bolts for mounting the wear plate extend through the bolt hole, and the nuts and washers connected to the bolts bear against the tapered radial draft surface.

6 Claims, 15 Drawing Sheets

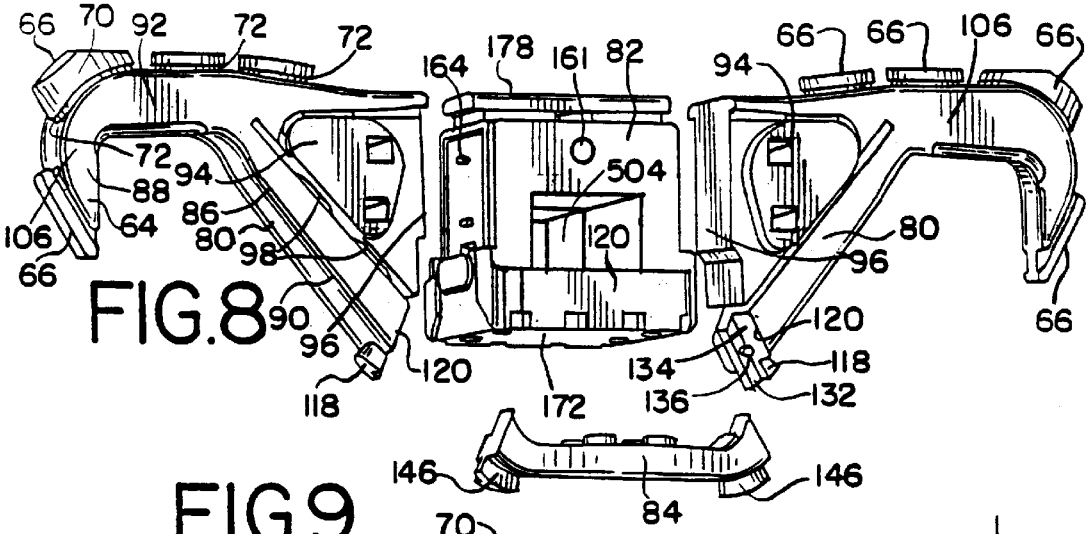
FIG.8
FIG.9
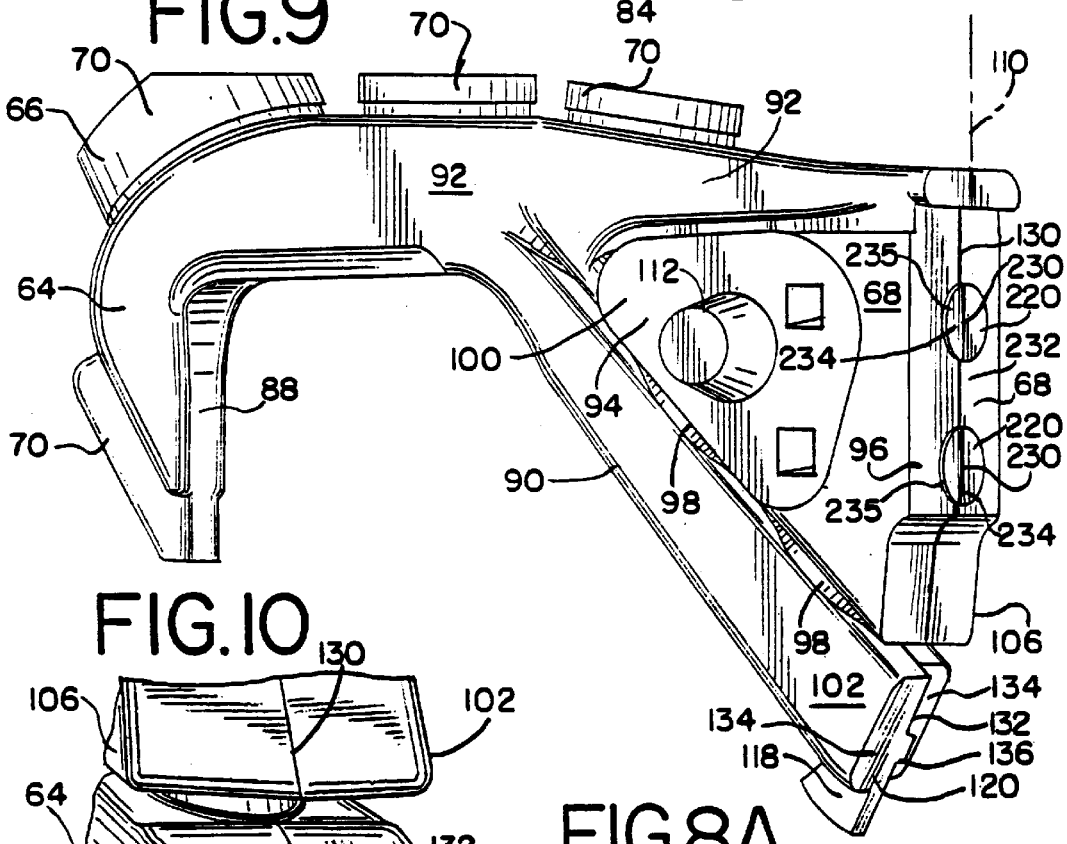
FIG.10
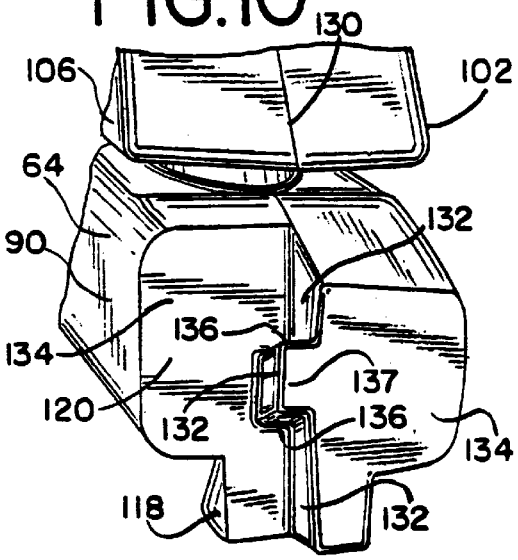
FIG.8A
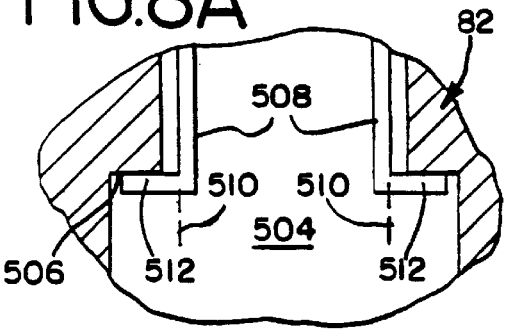

368
457
461
348
346
350
346

306
20
393
20
334
210
344
312
339
304
312
312
337
340
334
312
342
326
308
452
450
452
446
448
344
454
328
316
314
306

337
340
339
341
343
342

457
461
463

SIDEFRAMES FOR RAILWAY TRUCKS

This is a division of application Ser. No. 08/780,546 filed on Jan. 8, 1997, now U.S. Pat. No. 5,752,564, the entire disclosure being part of the disclosure of this application and being hereby incorporated by reference herein.

BACKGROUND OF THE INVENTION

1. Field of the Invention

The present invention relates to railway trucks and other casting products, methods of making such castings, and to cores used in making such metal castings.

2. Description of the Prior Art

In the past, in making hollow cast metal bodies, it has been known to use cores made of bonded sand supported in green sand molds to produce the hollow castings. The cores have been used to create the hollows or open spaces in the castings.

Cores have commonly been made in core boxes, typically having cope and drag halves that are brought together along a parting line. There is a cavity in the core box, and a mixture of sand and bonding material are introduced into the cavity and cured. The core box cope and drag portions are then parted along the parting line, generally being pulled apart vertically. Because of the need to pull the cope and drag portions apart, the sizes and shapes of the cores to be produced have been limited: the cores have not been able to have parts that would interfere with the movement of the cope portions away from the drag and with removal of the cores from the cope and drag portions. Thus, it typically has been necessary to produce several different cores that are later joined or placed together in the green sand mold.

In the case of cast metal sideframes for railway trucks, many different core shapes have been needed to produce the basic shape of the interior of the sideframes and bolsters. As shown in FIGS. 15–17, more than twenty cores have been required, with some different cores sometimes adhered together in a separate process step before being placed in a receiving cavity in the mold, and with many different cores and groups of cores separately placed in the mold. While some cores such as a window core and bolster opening cores have been supported on core prints, many of the cores have been supported on chaplets on the mold surface. In addition to the placement of the cores being a labor intensive operation, the use of such multiple cores has been problematic from a quality control standpoint. With so many joints between the faces of the multiple cores, there is a potential for many fins to be formed on the interior of the casting. To remove these fins through a finishing operation has been difficult since the fins are on the interior of the casting. Moreover, these fins create another potential quality control problem since they could give rise to stress risers that could form along the fins. Other potential quality control problems arise from the potential for shifting of the cores' positions in the mold prior to or during the casting operation. If the cores shift position, the thickness of the walls of the casting could vary from the design.

In addition, multiple cores may be so thin that core rods are required to be used to support the sand. These core rods add to the cost of the process and complicate cleaning of the castings.

Another problem can arise in connection with the friction plates at the back of the columns of the cast sideframe. Such plates are bolted to the columns through bolt holes in the columns. These bolt holes are along a joint on the interior side of the column formed by the mating cope and drag cores. Any misalignment of the cores along the joint could cause the metal to have a stepped surface at the bolt hole, resulting in the potential for uneven or improper loading of the bolt.

Another problem can arise in connection with areas of the sideframe around lightener holes and other openings in the sideframe wall. Metal fins can form around these openings, and sometimes form facing the interior of the casting. To finish such a casting by removing these fins may be difficult to accomplish manually since the fins are less accessible to the worker. In addition, it is very difficult to remove interior fins through automation.

Similar problems have arisen in producing cast metal bolsters for use in railway trucks. Like the sideframes, bolsters have hollow interiors, and have traditionally been made with multiple cores to form the interior walls and interior surfaces of the outer walls. Sixteen separate cores have been used to produce such castings, with cope and drag portions sometimes adhered to each other or juxtaposed along joints, as in the case of the sideframes cores, with chaplets supporting the cores on the mold surface, and with separate cores inserted into the cores to define holes for bolting side bearings and dead lever lugs to the bolster.

Similar problems as those outlined for sideframes have arisen with respect to quality control for bolsters. The positions of the cores on the chaplets may shift in the mold, creating the potential for making a casting with less than or more than desirable wall thicknesses. Bolster production has required that the multiple cores be placed in a mold in a labor intensive operation with multiple joints where stress risers could form. And like the sideframes, interior fins could form around lightener and other openings, fins that could be difficult and labor intensive to remove and that are not conducive to removal through automated finishing operations. Moreover, fins can form on the edges of the openings which can be stressed and damaged during the removal operation in the case of both sideframes and bolsters.

In the cases of both sideframes and bolsters, the cores used for holes may be misaligned, creating a hole with an offset axis. In use, it may be difficult to properly connect an appendage such as a dead lever lug or side bearing through an off-axis hole, and the bolt may be unevenly stressed or the nut or washer may not be seated flush against the casting surface.

The present invention addresses various aspects of these problems in the prior art.

SUMMARY OF THE INVENTION

The present invention addresses various aspects of the prior art problems, and different features of the invention effect improvements in different aspects of the cores themselves, in the process of casting metal bodies using such cores, and in the cast metal bodies such as sideframes and bolsters. Some of these improvements may apply to both sideframes and bolsters, and some may prove beneficial in use in casting other metal bodies. And while the present invention provides many improvements for different aspects of sideframe and bolster cores and production, the different aspects of the invention may be used singly or in combination with each other to achieve the various improvements disclosed.

In one aspect, the present invention reduces the number of cores needed to make sideframes and bolsters, to improve the efficiency of production to produce sideframes and bolsters of consistent quality. With fewer cores, the number of joints in the cores and therefore the number of potential fins or joint lines on the castings are greatly reduced. This reduction in the number of cores is accomplished by consolidating cores. These consolidated cores are supported on the drag mold surfaces without weight-supporting chaplets to reduce the potential for shifting of the cores.

For the sideframe, the cores can be consolidated to provide two one-piece end cores, a one-piece center core, and a one-piece bottom center core. The one-piece end cores and center core may be supported on the drag mold surface on core prints without weight-supporting chaplets. The core prints are sized, shaped and positioned so that the four cores are supported by the prints, with no chaplets required to support the cores. In some embodiments, the core prints also serve to locate the one-piece end core on the drag mold. And in some further embodiments, a locator boss with a draft surface may be provided on one of the core prints to further ensure proper positioning of the end cores on the drag mold surface. The present invention also encompasses methods of making sideframes using such cores as well as the resulting sideframes.

In another aspect, a one-piece sideframe center core is provided for sideframes for railway tracks. The one-piece center core has a bolster opening portion and an integral spring seat portion that are entirely supported on the drag mold surface without weight supporting chaplets. A top member portion is connected to the bolster opening portion through a bridge so that the top member portion may be supported above the drag mold surface by the bolster opening portion, free from any supporting chaplets.

In another aspect, to form bolt holes, the one-piece sideframe center core may include bolt hole pin cores formed to be integral with the bolster opening portion to ensure that the axes of the bolt holes are properly aligned.

In another aspect, the present invention provides cores with mating stepped surfaces that allow one core to support another core without weight-supporting chaplets. The stepped surfaces may provide support in three directions. Stepped surfaces may be used to support a bottom center core on the two one-piece end cores for the sideframe, to support two end cores on the center core of a bolster and may be applied to casting other types of bodies as well. The bottom center core may be a one-piece core with mating stepped surfaces. In either case, the stepped surfaces may also employ keys and keyways to further stabilize the positions of the cores.

The stepped surfaces may also be used to support parts of the cores used to make railway car truck bolsters. The present invention allows for the production of railway car truck bolsters with a center core with stepped outboard ends to support stepped inboard ends of end cores. The stepped surfaces may support the end cores in three directions, eliminating the need for weight support chaplets between the end cores and the drag mold surface. The stepped surfaces may have keys and keyways to ensure proper location of the cores.

In both the sideframe and the bolster, the end products can be expected to have witness marks corresponding with the shape of the stepped supports. The witness marks may comprise fins or joint lines that are offset or stepped in shape on the interior walls of the sideframes and bolsters. With consolidated cores, the interior walls may be expected to be otherwise free from interior fins and joint marks.

In another aspect, the bolster center core may be a one-piece center core. A pair of integral core prints are provided for supporting the core in the mold. The core prints are connected to the core body through necks or bridges corresponding with holes in the bolster sidewalls. The necks or bridges correspond in size, shape and position with each of the holes in the bolster sidewall. The prints span the widths and heights of the necks. The prints may, in some embodiments, have stepped surfaces for locating the core with respect to the drag mold. In some additional embodiments, the core print may be used to define part of the bolster center plate or bowl and part of the outside of the casting.

In another aspect, the present invention provides one-piece end cores for the bolster. The two ends of each one-piece end core may support the entire weight of the core in the mold, without support chaplets between the core and the drag mold surface. In some embodiments, the one-piece end core may have integral bolt hole pin cores extending out from the top surface for side bearings.

In another aspect, a bolster is disclosed wherein interior support ribs have opposite faces that are substantially parallel to the transverse axis of the bolster throughout their entire height. The bolster has top and bottom portions, and the faces of the transverse ribs in the top and bottom portions do not diverge from a vertical plane between them in the same direction. The center core for the bolster is similarly constructed. By making the ribs of the bolster with this configuration, the bolster center core can be made as one-piece and pulled from the core box as one-piece without damage to the core.

In another aspect, other improvements are made to the structure of the sideframe at the column bolt holes for connecting the friction plates to the sideframes. The sideframe bolt holes are surrounded by a radial draft, a depression on the interior surface of the column wall formed by a conical protrusion in the end core. Such a radial draft can be formed from use of such a conical protrusion along a parting line of a one-piece end core as set forth in other aspects of the invention, and may also be used in traditional multiple core settings. With such a tapered surface or radial draft surrounding the bolt hole, the outer circumference of a washer or nut may bear against the radial draft surface for even and complete loading.

In another aspect, the cores of the present invention are shaped to move any fins around openings or holes in the casting to the exterior of the casting for simplified removal during a finishing operation. The invention accomplishes this improvement through the use of wraparound print supports at some openings or holes. Each wrap-around print support comprises a neck or bridge joining the print to the core body. The edges of the core print that mate with or meet the mold surface are spaced beyond at least a part of the circumference or perimeter of the bridge or neck. The circumference or perimeter of the neck or bridge defines the edge of the casting around the opening or hole so that the innermost part of the edge forms at a position spaced from the juncture of the core print and mold where a fin could form. The neck or bridge may be concave so that the resulting cast product has convex edges around the opening or hole.

BRIEF DESCRIPTION OF THE DRAWINGS

FIG. 8 is an exploded perspective view of the four one-piece sideframe cores, showing the opposite side of cores shown in FIG. 7.

FIG. 8A is a partial cross-section of the central opening of the center core of FIGS. 6–8, showing lift arms engaging the core for lifting and moving the core.

FIG. 9 is a perspective view of one of the one-piece sideframe end cores of the present invention.

FIG. 10 is a partial perspective view of the sideframe bottom center core end of the diagonal tension arm portion of the sideframe end core of FIG. 9.

DETAILED DESCRIPTION

Figure 1:
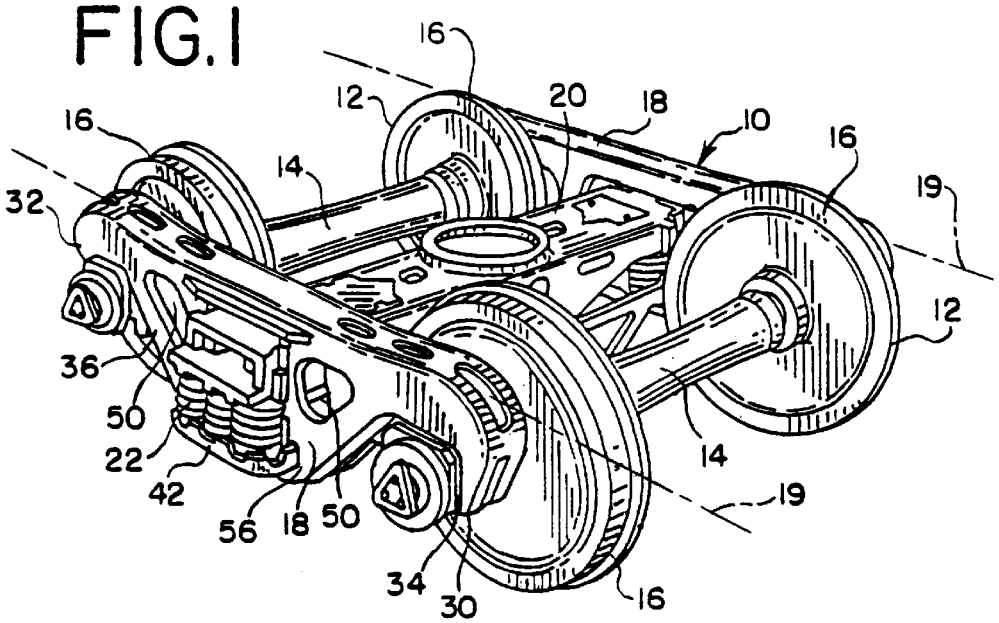
FIG. 1 is perspective view of a railway car truck, with sideframes and a bolster.
Figure 2:
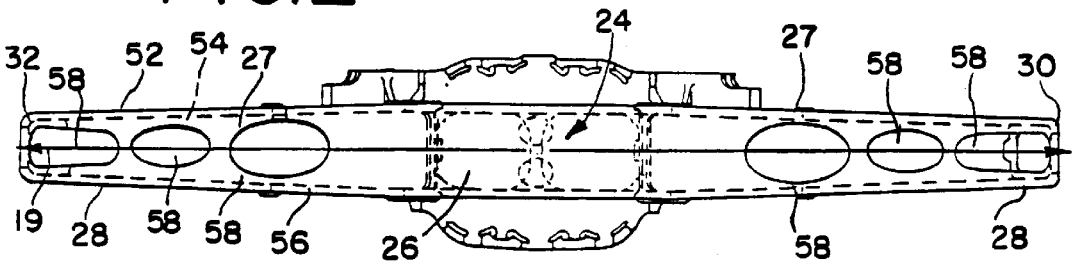
FIG. 2 is a top plan view of a sideframe that may be made according to the present invention.

A railway truck 10 that may utilize cast metal components of the present invention is illustrated in FIG. 1. As there shown, a typical railway truck 10 includes a pair of wheelsets 12, each wheel set having an axle 14 with a wheel 16 at the end of each axle 14. The two wheelsets 12 support a pair of spaced, parallel sideframes 18. The two sideframes 18 have longitudinal centerlines 19 and are spanned by a bolster 20, which is received in a bolster opening 21 in the middle of each sideframe. The bolster rides on a springset 22.

The present invention provides improved sideframes and bolsters, and methods of making such cast metal bodies, as well as cores to be used in making such cast metal bodies. Use of the method and cores of the present invention should be beneficial in simplifying the making of cast metal sideframes and bolsters, as well as in improving the quality and reducing the weight of such products. The principles of the casting method and core designs should also prove applicable to the production of other cast metal bodies.

The sideframes disclosed in U.S. Pat. No. 5,481,986, issued Jan. 9, 1996 to Charles P. Spencer, Franklin S. McKeown and Donald J. Lane and assigned to Amsted Industries Incorporated, Chicago, Ill., may be made in accordance with the principles of the present invention, and the disclosure of that patent is incorporated by reference herein in its entirety.

As shown in FIGS. 2–5, a sideframe 18 made in accordance with the present invention generally includes a top member 24 having a center portion 26 and two similar top end portions 28 connected with the center portion 26 through compression member portions 27. At the front and rear ends 30, 32 the sideframe has pedestal jaws or pedestals 34 to be mounted on a wheelset 12 as illustrated in FIG. 1. Each pedestal includes an outer pedestal leg 29, a roof 31, an inner pedestal leg 33 and a journal bracket flange 35.

Each sideframe 18 also includes a tension member or lower member 36 comprised of a bottom center portion 38 and two integral diagonal portions 40 each extending from the bottom center portion 38 toward the pedestals 34. A spring seat 42 is on the bottom center portion 38 of the tension member 36, between the bottom center portion 38 and top center portion 26 of the top member 24. The middle of the sideframe has a lower bolster opening 44 above the spring seat 42 to receive the spring set as shown in FIG. 1. The middle of the sideframe also has a bolster opening 21 between the lower bolster opening 44 and the top center portion 26 of the top member 24 to receive the end of the bolster 20 as shown in FIG. 1. A column 48 extends between the top member 24 and tension member 36, along each side of the bolster opening 21 and lower bolster opening 44. Each sideframe 18 also has two side windows 50. Each side window 50 is between the bolster opening 21 or columns 48 and the pedestals 34 at the front and rear ends 30, 32 of the sideframe 18, between the end portions 28 of the top member 24 and diagonal arm portions 40 of the tension member 36.

Figure 4:
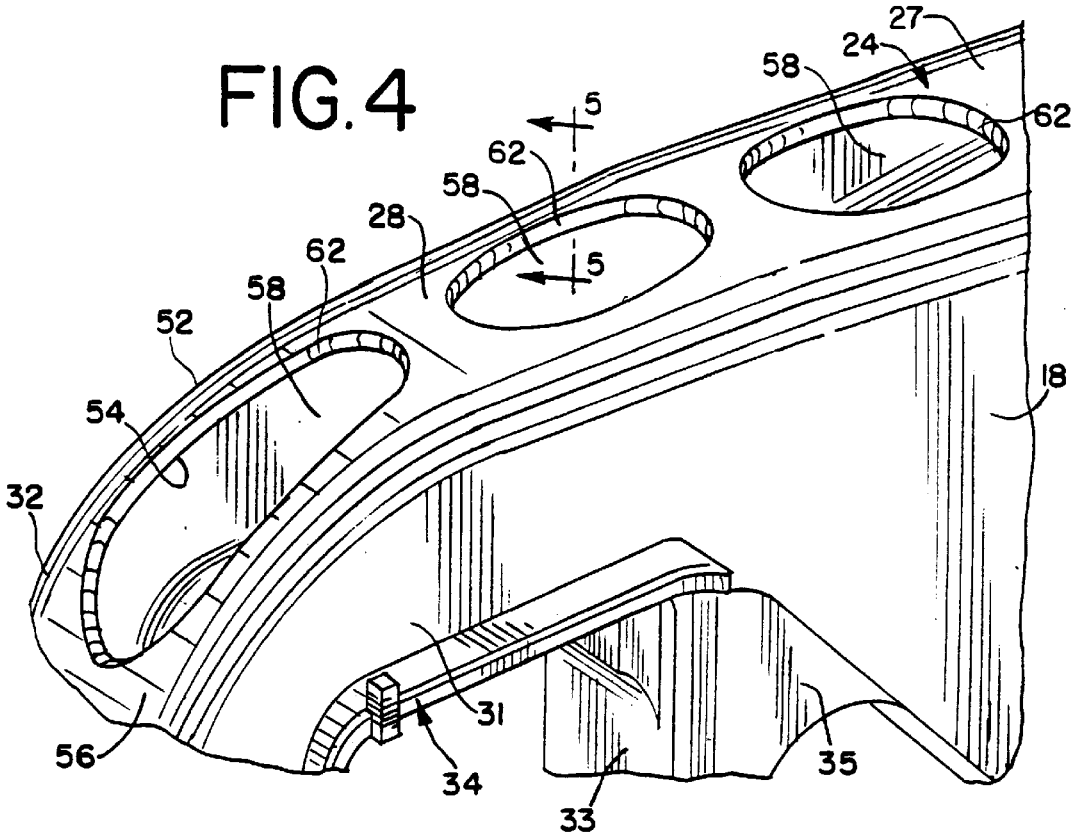
FIG. 4 is an enlarged partial perspective view of the top member of the sideframe of FIG. 2.

The illustrated sideframe 18 is hollow, with exterior 52 and interior 54 sides or surfaces of its cast metal walls 56. There are a plurality of openings in the cast metal walls 56, including lightener openings 58 in the top surfaces of the top member 24. Other openings 60 are provided, for example, in the walls between the side windows 50 and the diagonal arm portions 40 of the tension member, between the side windows 50 and the top end portions 28 of the top member 24, and in the lower surface of the center portion 26 of the top member 24. The walls 56 at each opening have an edge 62, as shown in FIGS. 4–5, that curves outwardly, that is, the edge 62 is convex.

Figure 3:
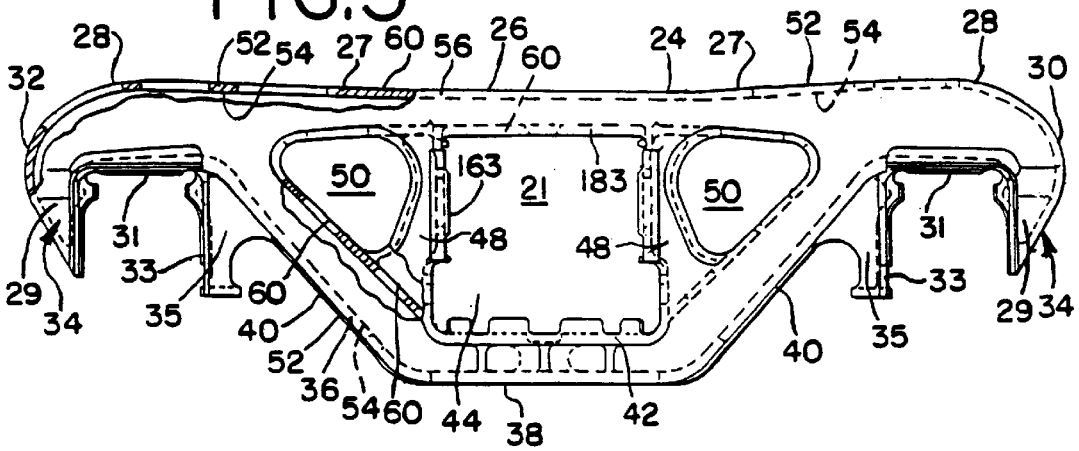
FIG. 3 is a side plan view of a sideframe made according to the present invention with parts shown in section.

As used herein, references to the "tension member" 36 and "diagonal portions" 40 of the tension member are not intended to include the journal bracket flanges 35 and inner pedestal legs 33, shown in FIG. 3, unless otherwise noted.

Figure 5:
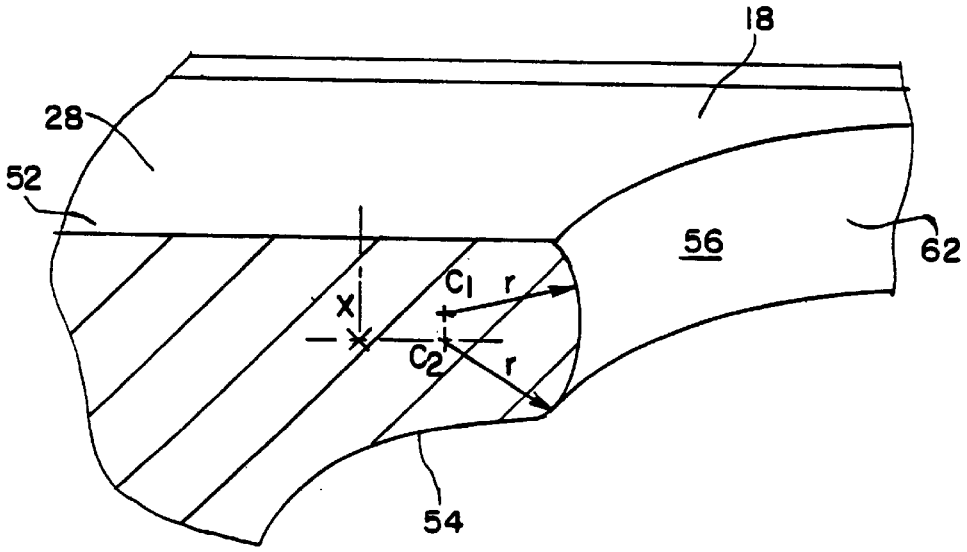
FIG. 5 is a cross-section taken along line 5—5 of FIG. 4.

As shown in FIG. 5, the illustrated edges have radii of curvature designated "r" and each illustrated edge has two centers of curvature designated "$c_1$" and "$c_2$". The radii of curvature "r" are about one-half the thickness of the metal walls 56, represented by the designation "x" in FIG. 5. The centers of curvature $c_1$ and $c_2$ are aligned, with the outermost center of curvature $c_1$ at a distance less than "x" from the outer surface of the metal and the innermost center of curvature $c_2$ centered between the outer and inner surfaces of the metal wall. The distance "x" is less than "r" in the illustrated embodiment In the illustrated embodiment, the sideframe walls have thicknesses at the lightener openings of about one-half inch, and the radii of curvature of the edges 62 are about one-quarter inch, with $c_1$ positioned less than one-quarter inch from the outer surface and $c_2$ positioned one-quarter inch from the inner and outer surfaces. Alternatively, the cast metal wall could have a single center of curvature, with, for example, a radius of curvature greater than one-half the thickness of the metal, that is, greater than the distance "x" shown in FIG. 5.

The curved edges 62 of the sideframes at the lightener openings 58 and other openings 60 are formed by the method of the present invention, using unique cores 64 having unique core prints 66 as illustrated in FIGS. 6–14. Each core 64 has a core print 66 corresponding with each lightener opening 58, and other opening 60 in the walls 56 of the sideframe 18 may also have core prints as illustrated. Each core 64 has an outer surface 68 from which the core prints 66 extend outwardly. Each core print 66 includes a core print body 70 to be received in a mating cavity in a mold to produce the cast metal part. Thus, the core print bodies 70 may serve to support and properly position the core in the mold. Each core print body 70 is integral with the remainder of the core and is connected to the core outer surface 68 through a bridge or neck 72. Each bridge or neck 72 has a thickness, designated "n" in FIG. 11, corresponding with the desired thicknesses of the walls 56 of the cast metal at the edges 62. Each neck or bridge 72 has a circumference or perimeter that is spaced inward of the edges 73 of the core print that meet or mate with the mold surface. Each neck or bridge 72 forms one of the metal edges 62 in the casting, the inner circumference of the edge 62 being spaced inward from the juncture of the core print and mold so that any fin forming at the juncture of the core print and the mold is spaced from the inner circumference of the edge. Having such a neck or bridge is expected to be beneficial in ensuring that if a fin is formed during the casting process, it should form on the exterior of the casting instead of the interior, making it much simpler to remove the fin through machining or other operation. Moreover, the hole should not fin over and should not form on the edges of the opening which could be stressed, particularly if damaged during fin removal. In the illustrated embodiment the necks or bridges 72 are concave to form convex edges 62.

Figure 11:
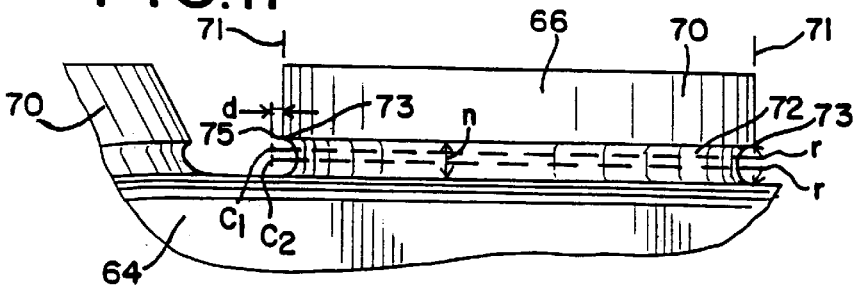
FIG. 11 is a partial side plan view of one of the core prints of the core of FIG. 9.

In making such cores, core boxes having cope and drag portions may generally be used. Such core boxes are generally separated along a parting line to remove the formed core therefrom. To accommodate such removal where the parting line lies in a plane perpendicular to a plane through the centers of curvature of the neck or bridge 72, the embodiment illustrated in FIG. 11 provides a curved concave neck or bridge with a thickness "n" and with two aligned centers of curvature, designated "$c_1$" and "$c_2$", each having a radius "r". The two centers of curvature comprise circles lying outside or beyond a plane 71 through the junctures of the neck 72 and core print body 70. at the edges 73 of the core prints that meet the mold surface. Alternatively, the bridge 72 could have a single center of curvature and a radius of curvature greater than one-half the thickness of the bridge "n". With either embodiment, the core neck or bridge does not curve back upon itself in a manner that would interfere with movement of the core relative to the cope and drag parts of the core box. Instead, each juncture 73 is spaced a distance "d" from a plane 75 through the nearest aligned centers of curvature $c_1$ and $c_2$. The distance "d" is equal to the length of the radius of curvature less the distance x. It should be understood that the present invention is not limited to such curvatures; the neck or bridge could alternatively comprise a cylindrical surface, for example.

At other locations spaced from the parting line, it is not necessary that the necks or bridges be curved, have two centers of curvature, or have a radius of curvature of the neck greater than one-half the thickness of the neck. Thus, for example, in the cores for forming the bolster of the present invention, the radius of curvature for the necks or bridges may be on the order of one-quarter inch, with the thickness of the neck, between the outer surface of the core body and the core print body being less than about one-half inch to produce a cast metal body having walls with thicknesses of less than about one-half inch.

It may be desirable to vary the thickness of the walls of the sideframe, as will be understood by those of skill in the art, to minimize weight while achieving the desired strength. In the illustrated embodiment, the thicknesses of the walls vary, being on the order of about one-half inch in some areas and on the order of about three-quarters of an inch in other areas. The dimensions of the necks or bridges vary according to the desired thicknesses.

In the illustrated embodiment the lightener openings in the cast metal sideframe are slightly smaller than those shown in U.S. Pat. No. 5,481,986 to move the openings away from the radius joining the top wall and each sidewall. The illustrated lightener openings 58 in the top member 24 have widths ranging to a maximum of 3.24 inches. The lengths of the two lightener openings nearest the center of the top member are each about six and one-half inches long; each is spaced from the edge by 1.88 inches and from each other by a distance of about two inches. The end lightener hole is spaced 1.62 inches from each edge and does not extend to the outermost part of the outer pedestal leg 29. However, beading around the openings is removed in using the wrap-around prints so that there should not be any weight gain.

Figure 6A:
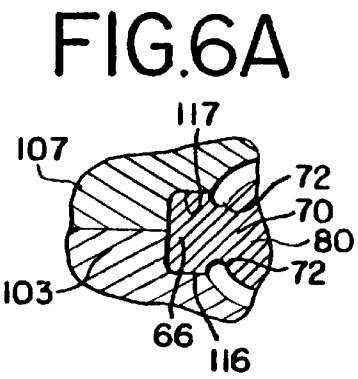
FIG. 6A is an enlarged partial cross-section of a portion of a sideframe core received within the cope and drag portions of a mold.
Figure 7A:
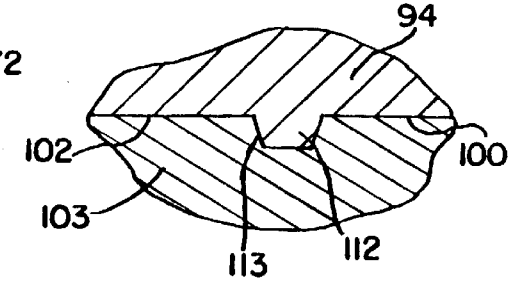
FIG. 7A is a partial cross-section of the one-piece end core of FIGS. 6–7, showing the locator boss received in a mating hole in the drag mold surface.
Figure 6:
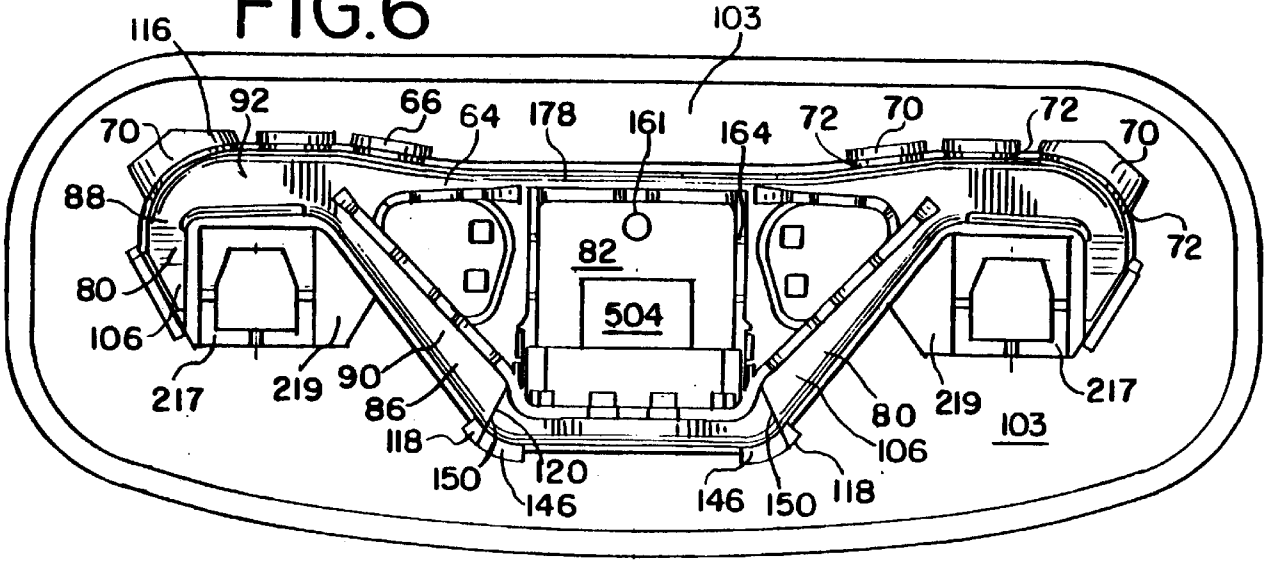
FIG. 6 is a top plan view of the four one-piece sideframe cores of the present invention in place in a drag mold flask with other cores shown for purposes of illustration.
Figure 7:
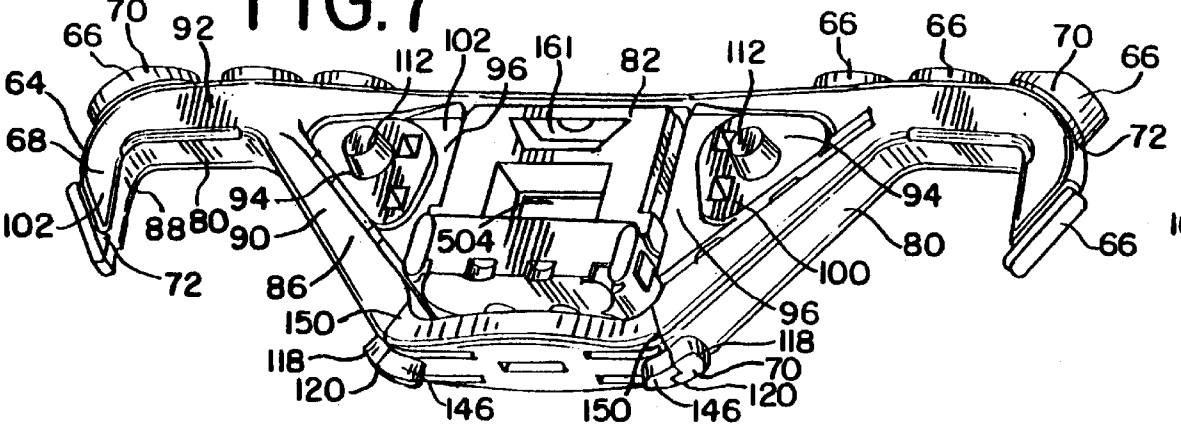
FIG. 7 is a perspective view of the four one-piece sideframe cores, showing the portions that are provided to rest against the drag side of the mold surface.

Another aspect of the present invention may be seen in FIGS. 6–8, illustrating the core consolidation achieved in the method of the present invention. As there shown, the interior surface 54 of the walls of the sideframe top member, tension member and columns may be made using four cores: two one-piece sideframe end cores 80, one one-piece sideframe center core 82 and one one-piece bottom center core 84.

Each of the illustrated one-piece end cores 80 of the present invention have a core body 86 with a pedestal portion 88 for defining an interior surface of the sideframe pedestal 34 at the front 30 or rear 32 end of the sideframe. In the illustrated embodiment, the pedestal portion 88 defines the interior surface of the outer pedestal leg 29; the one-piece end core also defines the interior surface of the pedestal roof 31. An integral diagonal tension arm portion 90 serves to define an interior surface of the sideframe's diagonal portion 40 of the tension member 36. A top member portion 92 of the one-piece end core 80 also extends from the pedestal portion 88, and serves to define the interior surface of the top end 28 and compression member 27 portions of the top member 24. The one-piece end core 80 also includes an integral side window support 94 between the diagonal tension arm portion 90, the top portion 92, and a column portion 96. The side window support 94 serves to define one of the side windows 50 of the sideframe 18, and as shown in FIG. 9, is connected to the diagonal tension arm portion 90 and top portion 92 of the core through necks or bridges 98 that define the openings 60 in the diagonal portion of the tension arm and underside of the compression portion 27 of the top member 24. The column portion 96 serves to define the interior surface 54 of the column 48 of the cast sideframe.

The side window support 94 has flat surfaces 100 that extend outward beyond the outer surface 68 of the core body 86. These flat surfaces 100 serve to support a part of the weight of the end core 80 on the mold, and lie in a plane spaced from the outer surface 68 of the core body 86 a distance of about one-half inch. Since this surface 100 on the drag side 102 of the core rests on the drag mold surface 103 of the mold cavity 104, and since this surface 100 on the cope side 106 bears against the cope mold surface (designated 107 in FIG. 6A for the cope mold surface at the print 70 on the top member portion 92), this spacing defines the thickness of the metal to be cast in this area of the sideframe. In the illustrated embodiment, these surfaces 100 on both sides 102, 106 of the core lie in planes.

In the illustrated embodiment, as shown in FIGS. 7 and 9, the side window support 94 on the drag side 102 of the end core 80 also includes a locator boss 112 extending out from the flat support surface 100. The locator boss 112 is received within a mating hole or opening 113 (FIG. 7A) in the drag mold surface 103 of the drag side of the mold to locate and support the core. The illustrated locator boss 112 has the shape of a frustum of a cone, that is, it has a slight draft for ease of making the core and ease of placement of the boss 112 in the mating hole 113. In the illustrated embodiment, as shown in FIG. 6, the cope side 106 of the end core does not have a locator boss, although it should be understood that a cope side locator boss could be provided if desired, along with a mating hole in the cope side of the mold.

Each end core 80 is further supported on the drag mold surface 103 by the core prints 66 corresponding with the lightener openings 58 in the outer surface of the top member 24. Another core print 118 is located at the bottom center core end 120 of the diagonal portion of the tension member. The core print bodies 70 are shaped to be received in mating openings 116 in the drag mold surface 103 and to support a portion of the weight of the end core on the drag mold surface and in mating openings 117 in the cope mold surface 107 (FIG. 6A) to stabilize and position the core with respect to the cope mold surface. The core prints 66, 118, side window supports 94 and locator boss 112 also serve to locate or maintain the position of the end core 80 in the mold during handling and, in combination with the contour of the mold surfaces 103, 107, to define the thickness of the metal to be cast, which may be about one-half inch grade C, B or B+ steel, for example, in the illustrated embodiment. In addition, the combination of the illustrated core prints 66, 118 and side window support 94 can support the entire sideframe end core 80 on the drag mold surface 103, without any support chaplets or other device to support or position the core.

The one-piece end cores 80 may be made as a single, integral piece by providing a core box (not shown) having cope and drag halves with surfaces defining the shape of the one-piece end core. As shown in FIGS. 9 and 10, a one-piece end core made with such a core box would have a parting line 130 in the plane of the longitudinal axis 110 of the core but would be free of joint lines. The interior surface 54 of a cast metal sideframe or other metal body would likewise be free from fins, joint lines or other type of witness mark other than a slight depression or witness mark perhaps at the parting line 130 and at the joints between the consolidated cores. As used herein, the expression "witness mark" in intended to be a generic expression encompassing both fins and joint marks.

Figure 15:
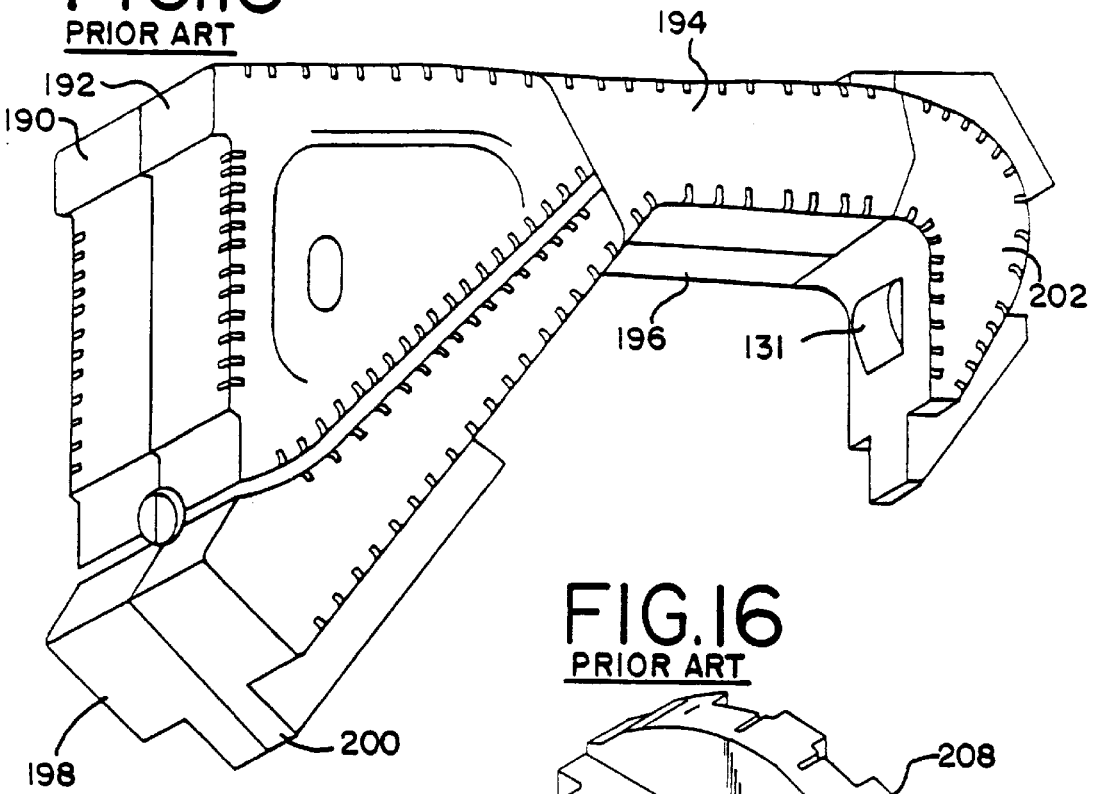
FIG.15 PRIOR ART
FIG. 15 is a perspective view of some of the multiple prior art sideframe cores replaced by the consolidated one-piece end core of the present invention.

To facilitate placement of the one-piece end cores 80 in the mold, the pedestal lug lightener 131 shown in FIG. 15 has been removed from the illustrated one-piece end cores since the presence of the lug lightener interferes with automated setting of the core in the mold. As shown in FIG.

6, the mold may contain a separate core 217 to define the shape of the pedestal opening, and the end core could not be placed in the mold with the core 217 in place if the lug lightener was retained.

Figure 12:
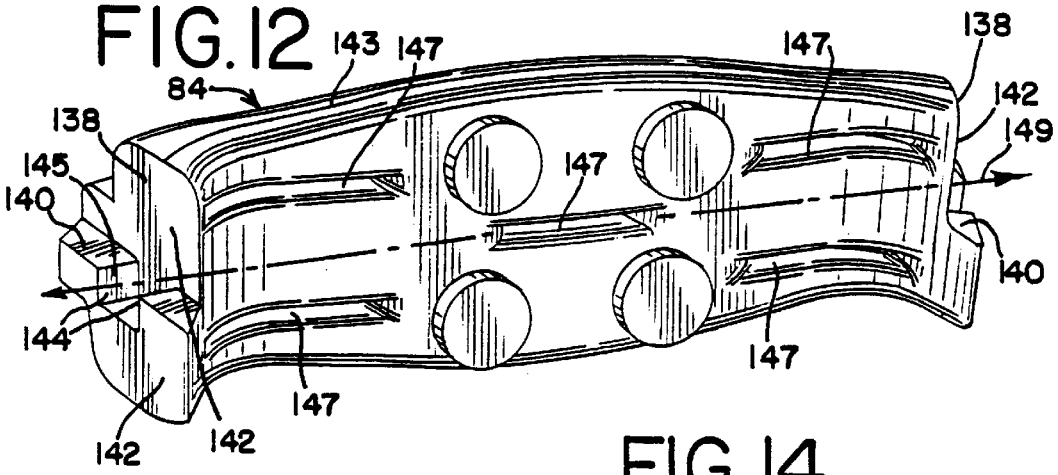
FIG. 12 is a perspective view of the bottom center core of FIGS. 6–8.

Another feature of the present invention relates to providing a stepped joint to support and locate the bottom center core 84 on the two end cores 80, free from any support chaplets or other extraneous device for supporting the weight of the sideframe bottom center core 84. As shown in FIGS. 8 and 10, the bottom center core end 120 of each diagonal portion of the tension arm has a stepped surface. The stepped surfaces on the end cores include a weight support member 132, a longitudinal limit member 134 and a lateral limit member 136, all lying in different planes. As shown in FIG. 12, the two ends 138 of the bottom center core 84 have mating weight support members 140, longitudinal limit members 142 and lateral limit members 144, all comprising surfaces lying in different planes. In the illustrated embodiment, the weight support members 132, 140 are substantially co-planar with the longitudinal axis 110 of the end cores and bottom center core, although, as will be understood be those in the art, the surfaces 132, 140 and others may have a draft in accordance with standard foundry practice, and such draft surfaces are intended to be included within the expression "substantially co-planar" as used herein. The longitudinal limit members 134, 142 lie in planes intersecting the longitudinal axis 110 and intersecting the planes of the weight support members 132, 140 and lateral limit members 136, 144. The mating lateral limit members 136, 144 lie in planes intersecting the planes of the weight support members 132, 140 and may comprise a key, designated 137 in the illustrated end core, and keyway, designated 145 in the illustrated bottom center core; it should be understood that the key could be formed on the bottom center core and the keyway on the end core if desired.

As shown in FIGS. 6–8, when the end cores 80 and bottom center core 84 are assembled, the bottom center core weight support members 140 rest on and are supported by the end core weight support members 132, and the bottom center core longitudinal limit members 142 and lateral limit members 144 are positioned by the end core longitudinal limit members 134 and lateral limit members 136. Thus, the entire weight of the bottom center core 84 is supported by the end cores 80 on their weight support members 132, 140 and relative movement between the cores 80, 84 is limited by the longitudinal 134, 142 and 136, lateral 144 limit members. The bottom center core 84 has a core print portion 146 at the joint with the end core that mates with the print 118 at the bottom center core end 120 of the diagonal part 40 of the tension member 36. Thus, the bottom center core may be supported and positioned above the drag mold surface 103 without support chaplets, since the core prints 66, 118, 146 and locator bosses 112 maintain the position of the end cores 80 and bottom center core 84, and the mold may be moved and used without the cores shifting position and without using support chaplets or other supports or positioning devices. However, to keep the bottom center core from floating upward during pouring of the molten metal, it may be desirable to place chaplets on top of the bottom center core to bear against the cope mold surface 107 and thereby hold the bottom center core down when molten metal is introduced.

As shown in FIGS. 6–7, the junctures of the end cores and bottom center core are at or immediately past the curvature points of the tension members 36, that is, the junctures are along the diagonal portions 40 of the tension members, near the bottom center portion 40.

Figure 13:
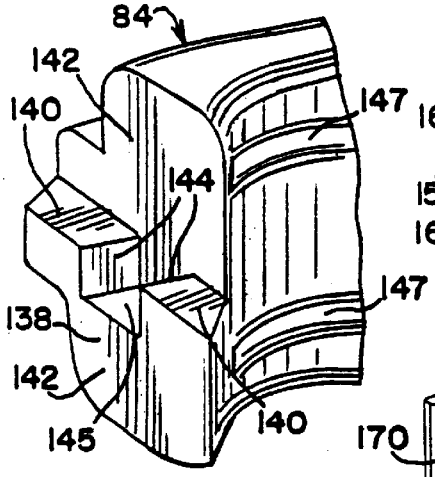
FIG. 13 is an enlarged partial perspective view of one end of the bottom center core of FIG. 12.

As shown in FIGS. 10 and 12–13, the lateral limit surfaces 136, 144 of the key and keyway are not perpendicular to the longitudinal limit members 134, 142, but are slightly askew so that the lateral limit surfaces 144 of the bottom center core may be formed substantially parallel to the parting line 143 (FIG. 12) of the bottom center core; the lateral limit surfaces 136, 144 may have a draft in accordance with standard foundry practices, and such draft surfaces are intended to be included within the expression "substantially parallel". This configuration facilitates removal of the bottom center core 84 from the core box.

Figure 18:
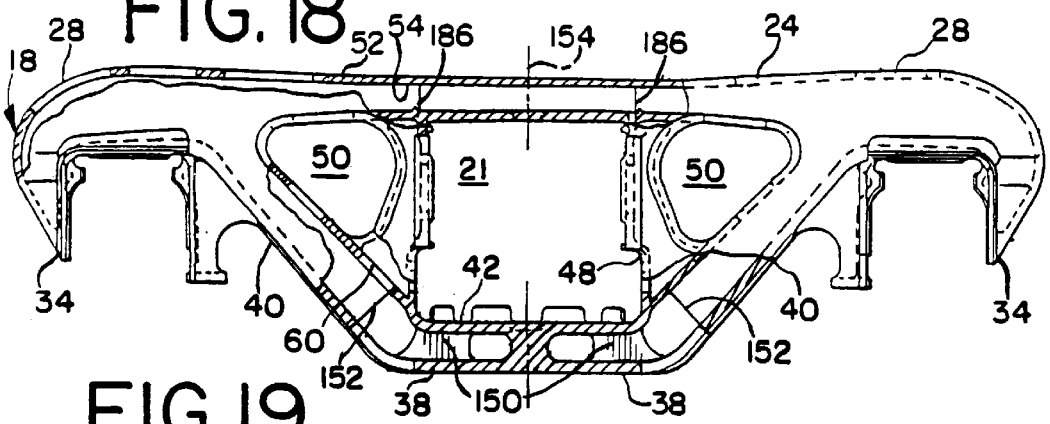
FIG. 18 is a partial cross-section of a sideframe made using the cores of the present invention, taken along the longitudinal centerline of the sideframe.
Figure 19:
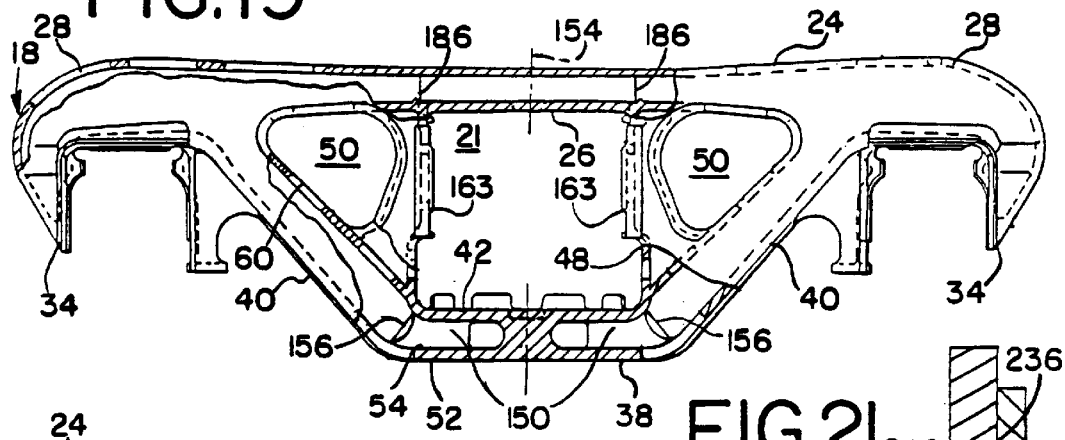
FIG. 19 is a partial cross-section of a sideframe made using the cores of the present invention, taken along the longitudinal centerline of the sideframe, showing the opposite side shown in FIG. 18.

The bottom center core 84 generally defines the shape of the interior surface 54 of the walls 56 of the bottom center portion 38 of the tension member 36 of the sideframe 18. Openings or slits 147 in the bottom center core, shown in FIG. 12, define internal support ribs 150 in the bottom center portion 38 of the tension member 36, as shown in FIGS. 18 and 19. Such support ribs 150 are shown in FIGS. 18-19 and extend to the spring seat 42 as illustrated, and correspond with five spaced slits 147 in the bottom center core 84. In the illustrated embodiment, all of the slits 147 are defined by spaced walls that lie in planes substantially parallel to the plane of the longitudinal axis 149 of the bottom center core 84 for ease of removal of the completed core from the core box.

It is generally to be expected that a casting made with the disclosed bottom center cores and end cores will have an internal witness mark corresponding with the junctions of or joints 150, 152, 156 between the cores. Because of the stepped surfaces at the joints 150, 152, 156, these witness marks are longitudinally offset on the interior surfaces 54 of the walls 56 in the casting. Thus, considering the two sides of the casting defined by the plane of the longitudinal centerline 19 of the cast sideframe 18, shown in FIGS. 18–19, the distances between the witness marks 152 and the transverse centerline 154 on one side of the longitudinal centerline 19 of the sideframe are greater than the distances between the witness marks 156 and the transverse centerline 154 on the opposite half of the casting. As shown in FIGS. 18 and 19, a casting having such offset witness marks 152, 156 can be expected to have been made using cores with stepped surfaces at the joints between cores.

Figure 14:
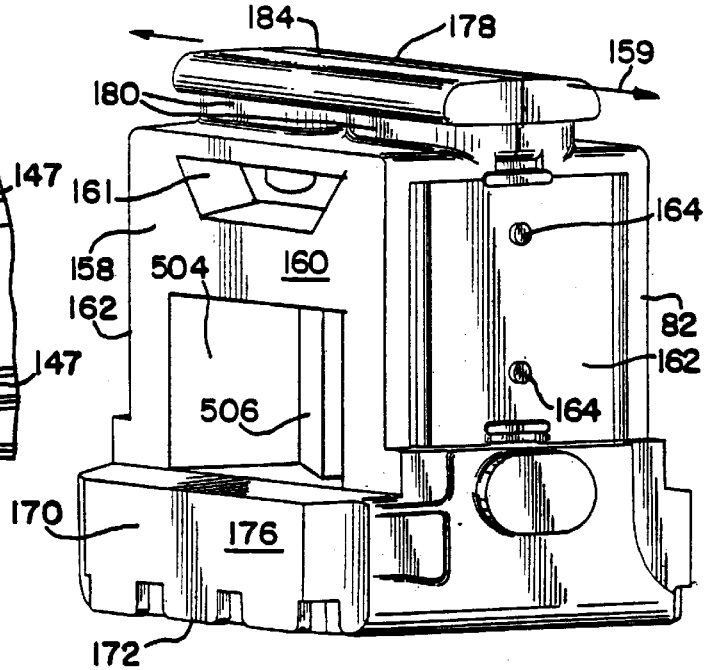
FIG. 14 is a perspective view of the sideframe center core shown in FIGS. 6–8.

A one-piece sideframe center core 82 is illustrated in FIG. 14. This core may generally be as described and shown in U.S. Pat. No. 5,481,986, although in the center core of the embodiment illustrated in the present application, the sideframe center core 82 and bottom center core 84 are separate elements rather than combined as disclosed in the issued patent. In addition, in the embodiment illustrated in FIG. 14, the column faces do not have lightener openings, but merely openings for bolts for connecting friction plates to the column faces.

The one-piece sideframe center core 82 of the embodiment illustrated in FIG. 14 includes a bolster opening element or portion 158 corresponding with the bolster opening 21 in the cast sideframe 18. The center core has a central longitudinal axis 159. The bolster opening portion includes a pair of planar support print surfaces 160 that lie in planes substantially parallel to the longitudinal axis 159 of the center core and substantially parallel to the longitudinal axes 110 of the end cores 80 when combined with the end cores as shown in FIG. 6. The planar support print surfaces 160 may rest on mating support print surfaces of the drag mold surface 103 to support a part of the weight of the center core on the mold and prevent molten metal flow into the area to become the bolster opening. At the ends of the two planar support print surfaces 160 are opposite column surfaces 162 which define the exterior side of the opposing faces 163 of the sideframe columns 48. The core column surfaces 162 are substantially parallel to each other and have vertically aligned cylindrical elements 164 extending outwardly from the surfaces with parallel axes aligned along the core's longitudinal centerline 159. These cylindrical elements comprise integral bolt hole pin cores. As shown in FIG. 6, when the center core 82 is combined with the two end cores 80, the cylindrical elements or bolt hole pin cores 164 meet the column portions 96 of the end cores to define bolt holes 166 in the opposing faces of the columns 48 of the cast metal sideframes for attachment of friction plates to the columns as shown in FIG. 19.

As shown in FIG. 14, the illustrated one-piece sideframe center core 82 includes an integral spring seat element or portion 170 to define the lower bolster opening 44 and top surface of the spring seat 42 in the sideframe. The bottom surface 172 of the spring seat element 170 is spaced above the bottom center core 84, and together with mating surfaces 174 in the drag and cope mold surfaces 103, 107, define a cavity in which metal is cast to form the spring seat 42. The spring seat element 170 also has planar support surfaces 176 which support a part of the weight of the center core element 82 on the drag mold surface 103 and mate with the cope mold surface 107 to assure proper positioning of the center core with respect to the mold surfaces.

The illustrated one-piece sideframe center core 82 also includes a top member center portion 178 that defines the interior surface 54 of the walls 56 comprising the center portion 26 of the top member 24. Integral necks or bridges 180 join the top member center portion 178 of the center core 82 to the bolster opening portion 158. The necks or bridges 180 correspond with openings 182 in the underside of the center portion 26 of the top member 24, as shown in FIG. 3.

Figure 40:
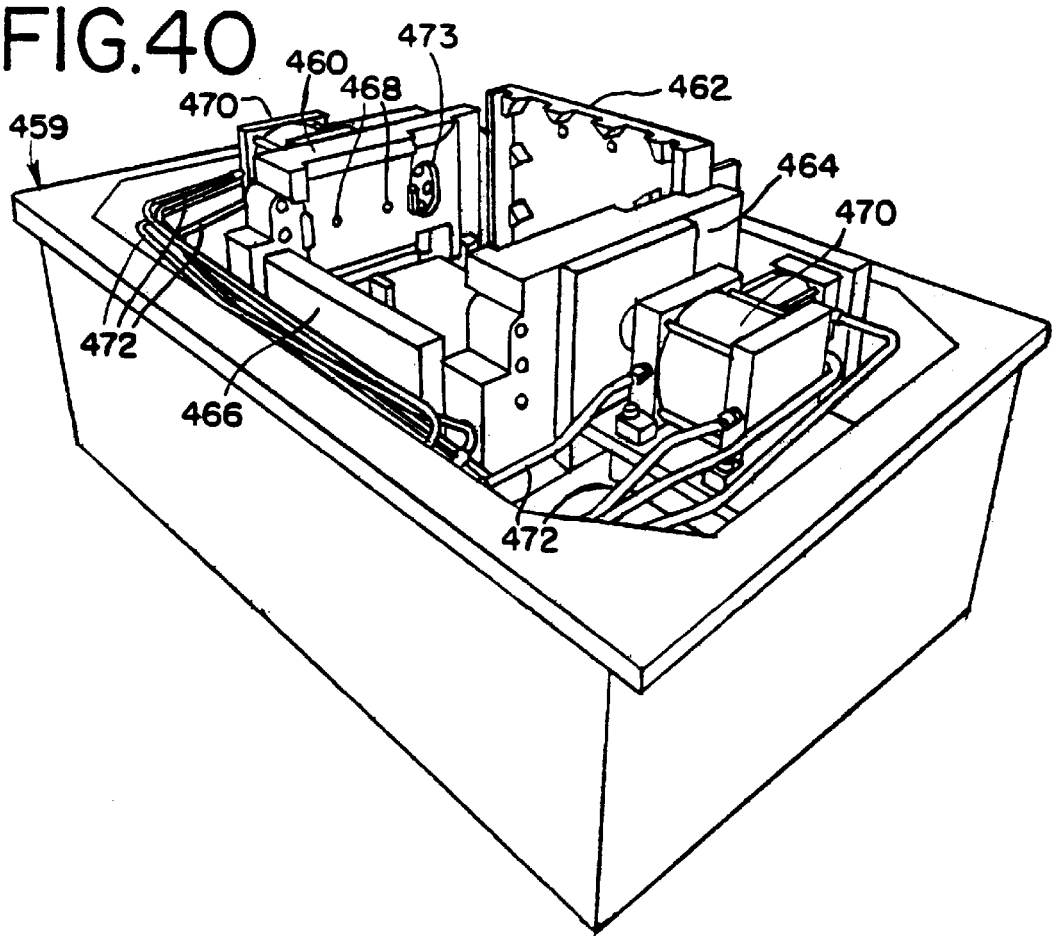
FIG. 40 is a perspective view of the drag side of a core box that may be used to make the sideframe center core.

The illustrated one-piece sideframe center core 82 may be made as a single integral piece by providing a core box with cope and drag portions surfaces defining the shape of the center core. The core may be made so that the longitudinal axis 159 comprises the parting line of the core box, with the resulting core being free from joints and having only a parting line 184 along its central longitudinal axis 159. To produce any indentations or protrusions in the core body that could be damaged during removal from the core box, the core box may be provided with movable parts that can be retracted when the core is to be removed from the core box. Such a core box is illustrated in FIG. 40. Automatic devices, such as pneumatic or hydraulic operated elements, may be used with the core boxes to move the movable parts as desired during the cycle. The core produced may only have a visible parting line on a portion of the core, such as along the central longitudinal axis 159 of the top member center portion 178 and necks or bridges 180 but not elsewhere.

A cast metal sideframe made using the illustrated sideframe center core 82 may be expected to have witness marks comprising either joint lines or fins 186 on the interior surface 54 of the walls 56 comprising the top member 24, as shown in FIGS. 18 and 19, where the center core top member center portion 178 portion meets the end core top member portions 92, as shown in FIGS. 6-8, but to be otherwise free of joint lines or fins in the areas of the sideframe defined by the center core 82. In addition, the center core 82 may be supported on the drag mold surface 103 solely by the support surfaces 160, 176 so that the cast metal in the area of the sideframe defined by the one-piece center core 82 has fewer chaplets; since there are no support chaplets, one side of the tension member bottom center 40 may be free from support chaplets, while the other side may have some location chaplets.

The one-piece sideframe center core 82 may also have gates 161 in the bolster opening element or portion 158, for movement of molten metal as will be understood by those in the art. The illustrated gates are included for purposes of illustration only and, if included, should be sized, shaped and positioned according to standard casting practices.

Figure 17:
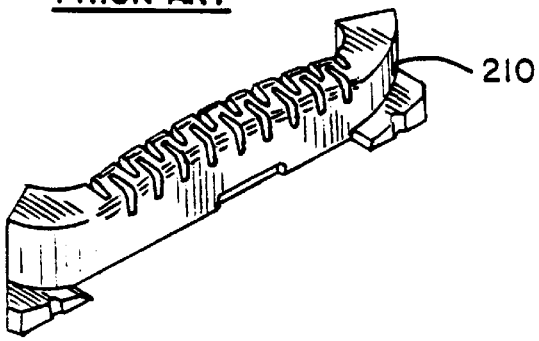
FIG.17 PRIOR ART
FIG. 17 is a perspective view of a part of the prior art cores replaced by the one-piece bottom center core of the present invention.

A cast metal sideframe made using the four illustrated cores 80, 82, 84 may be expected to have witness marks 186 on the interior surface 54 of the walls 56 comprising the top member 24, as shown in FIGS. 17 and 18, and the offset interior witness marks 152, 156 in the tension member 36, but the interior surface should be otherwise free of joint lines and fins in the areas of the sideframe defined by the center core 82.

Figure 16:
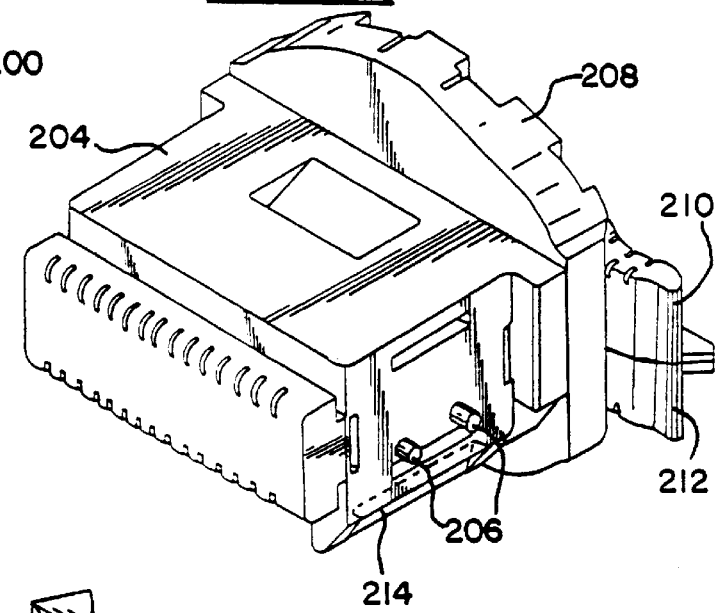
FIG.16 PRIOR ART
FIG. 16 is a perspective view of some of the multiple prior art sideframe cores replaced by the one-piece sideframe center core of the present invention.

The advantages of using two such one-piece end cores 80, one-piece center core 82 and one-piece bottom center core 84 can be seen from a comparison of the number of cores used in the prior art to produce the interior cavity of a sideframe. Prior art cores are illustrated in FIGS. 15–17. FIG. 15 shows a typical prior art core arrangement for making an end of a sideframe; seven cores were needed to form each end of the sideframe, for a total of fourteen cores, compared to a total of two cores in the present invention. The prior art cores for the sideframe end included: cope and drag side frame window cores 190, 192 to form the area of the side window 50 and column 48 interior; cope and drag side frame intermediate cores 194, 196 to form a part of the top member and pedestal roof interior; cope and drag sideframe tension cores 198, 200 to form the diagonal portions 40 of the tension member 36; and an end core 202 to form the interior of a part of the pedestal 34. These cores were not integral, but were juxtaposed or sometimes adhered together, with joint lines existing between each of the individual cores. The prior art also typically included a spring seat back up core (not shown) that was not integral with or adhered to another core. This substantial number of cores used in the prior art has been problematic in several respects: automation of the process of setting the cores in the mold is difficult since there are several small pieces that need to fit together in the mold; and there could be quality control problems with the prior art cores: shifts and movements of the individual cores or imperfections in the fit between adjoining cores could produce interior fins during casting or could result in the varying thicknesses of the casting walls; and if two cores such as the cores 198, 200 are not properly aligned, the metal casting may have a stepped or uneven surface at the juncture of the two parts. Multiple cores are often thin, requiring use of core rods to provide strength to the core. Removal of these core rods after the casting is formed adds to the cost of manufacture.

Similar disadvantages and problems arise in using the multiple cores for the prior art center portion of the sideframe. As shown in FIGS. 16–17, one example of prior art center cores generally required at least nine cores where the present invention provides two: a side frame bolster opening core 204, four column pin cores 206 inserted into the bolster opening core, a spring seat core 208 and cope and drag bottom center cores 210, 212 adhered together.

It should be understood that several additional cores are required for adding various appendages to the sideframe although those other cores will not be addressed by this invention. For example, there may be separate rotation lug cores added to the center core, although such cores could also be consolidated into the sideframe center core.

Moreover, an additional six cores (not shown) may be required in the manufacturing process. But even with these additional cores, the present invention consolidates twenty-three cores into four, reducing the total number of cores for making a sideframe from twenty-nine to ten. These additional cores may need to be supported by chaplets on the drag mold surface, and may require locator chaplets to secure their positions. Some of these additional cores that are used with the present invention are generally shown in FIG. 6, including the right and left journal cores 217 and right and left journal bracket cores 219. In addition, bracket cores to form slots for brake beams on the inboard sides of the sideframes would still be used, and the aright and left journal cores, right and left journal bracket cores and brake beam bracket cores may require use of weight-supporting or locating chaplets, so that the resulting sideframe would have some chaplets, although the number of chaplets and the problems associates with their use is greatly decreased with the present invention.

Thus, it can be seen that the present invention offers several advantages in making sideframes. By reducing the number of cores, any tendency for shifting of the multiple cores is reduced, reducing internal metal mismatches. The safeguard against shifting is enhanced in the present invention by the use of the locator bosses 112 on the end cores 80 and the stepped connections between the bottom center core 84 and the end cores that limit lateral and longitudinal movement. Similarly, the fit of the core prints 66 of the end cores in the mating areas of the cope and drag mold also stabilize the positions of the end cores and bottom center core. And since the four cores of the present invention are supported in the mold by the core prints, other cores and opening-defining parts, the castings can be made without support chaplets, increasing the efficiency of the manufacturing operation and minimizing the chance for shifting of the cores. In addition, the present invention minimizes the number of joint lines which normally result between the faces of multiple cores, to improve the appearance of the final casting, reducing the amount of preparatory or finishing work necessary to remove fins, and improving internal casting quality by eliminating or greatly reducing the potential for stress risers which tend to form along the entire joint line. And since the manpower required for proper placement of the four cores instead of twenty-three is substantially less, labor costs should be reduced. With fewer and larger cores, there is also a chance for automation of the assembly process. Moreover, as will be understood by those in the casting field, the tooling costs in creating a single mold, as well as the replacement and maintenance costs for retaining quality standards for each mold is substantial. It is expected that waste of mold sand will also be reduced with fewer cores being produced, further reducing costs. In addition, it is expected that with fewer cores and less relative motion between cores, there is a lower potential for sand particles to become dislodged and become inclusions in the finally cast metal. Inclusions can potentially become stress concentration areas or simply result in an area on the casting that requires surface clean up. Another advantage of the present invention is in eliminating or reducing the need to use core rods to strengthen the cores, simplifying production and reducing costs.

Another advantage of the present invention is in the assurance of proper placement and alignment of core pieces. In the case of the one-piece center core 82, the vertically aligned cylindrical elements 164 take the place of the column pin cores 206. The column pin cores 206 have typically been inserted into the surface of the side frame bolster opening core 204 after the cores 204, 206 have been formed, and there has been a potential for misalignment of the pin cores, resulting in bolt holes 166 in the final casting that may be angled, making it more difficult to insert a bolt through the hole. With the integral cylindrical elements 164, the resulting bolt holes should always be properly aligned.

Figure 20:
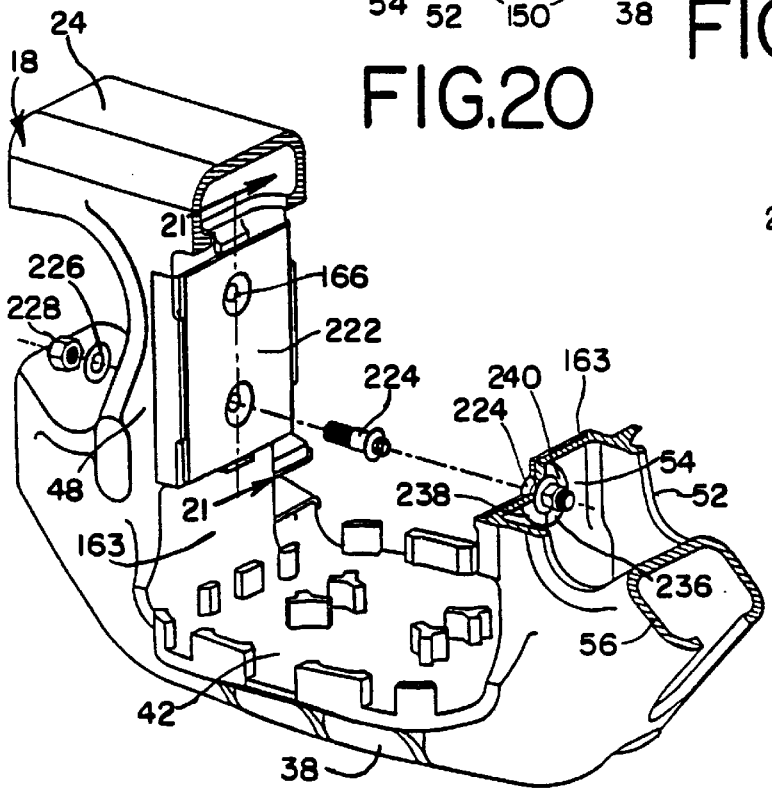
FIG. 20 is a partial perspective view of one of the columns, with parts broken away, showing a friction plate in place on one column, with the mounting nuts, bolts and washers shown in exploded view.
Figure 21:
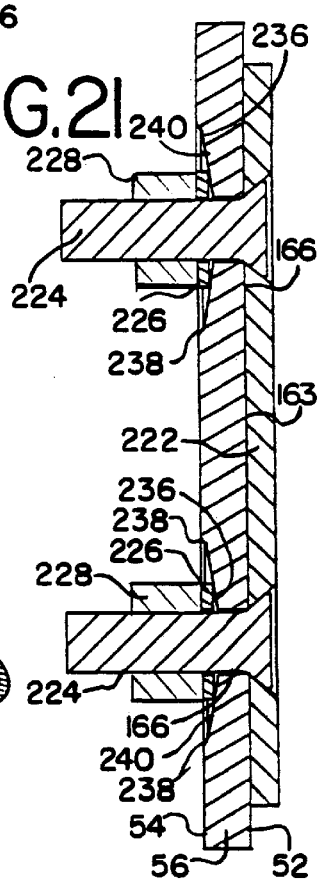
FIG. 21 is a cross-section taken along line 21—21 of FIG. 20.

Another feature of the present invention relates to provision of a pair of radial drafts 220 on the end core column portions 96 as shown in FIG. 9. As illustrated in FIG. 20, the facing exterior faces 163 of the columns 48 typically have bolt holes 166 for mounting friction plates 222 to the sideframe with bolts 224. As shown in FIG. 21, washers 226 and nuts 228 are tightened against the interior surface 54 of the column portion of the sideframe. If the interior surface 54 of the column is uneven, irregular or offset, then less than the entire flange of the nut or washer contacts the surface 54; during tightening, stresses could be concentrated at portions of the nut, resulting in breaking or bending of the nut or bolt, or a less than desirable clamping force holding the plates 222 in place. This problem could potentially occur in one-piece end cores having parting lines running through the bolt hole areas, as well as in multi-piece cores having separate cores adhered to or juxtaposed with each other at junctures or joints intersecting the bolt hole areas. To alleviate this potential problem, the present invention provides a pair of conical raised areas 220 on the column portions 96 of the end cores 80. As shown in FIG. 9, each raised area 220 comprises a raised center 230 extending furthest out from the outer surface 68 of the surrounding planar face 232 of the column portion 96 core. Each raised area also includes a tapered surface 234 extending from the raised center 230 toward the outer surface 68 of the planar face 232. The raised area has a circular outer periphery 235 that is spaced slightly above the planar face 232. The outer diameter of each raised area is about two and one-half inches. The tapered surface 234 and center 230 are shaped as a cone. The angle of the illustrated tapered surface is small, being on the order of one-third to one-half degree. In the illustrated embodiment, there are two vertically-aligned raised areas 220, and the parting line 110 of the core runs through the raised centers 230 of the two raised areas. When placed in the mold along with the other cores, the center of each raised area 230 of each end core contacts the free end of one of the vertically aligned cylindrical elements 164 to define the bolt holes 166 in the casting. Thus, as shown in FIG. 21, each bolt hole 166 in the casting is surrounded by a depression 236 in the interior 54 surface of the casting. The depression 236 has a circular edge 238 at or slightly below the interior surface 54 of the casting, and a tapered wall 240 extending between the edge 238 and the bolt hole 166 at the center of the depression. In use, the peripheral edge of the nut 228 or washer 226 should contact the tapered wall 240 of the depression around the entire circumference or perimeter of the nut or washer. Since the entire circumference of the nut or washer is in contact with the interior surface of the side frame, there should be no bending moment on the nut and no lessening of the clamping force or torque. Instead, use of the present invention should result in symmetrical loading of the washer and nut. It should be understood that the principle of this feature of the invention should be applicable to any setting where a bolted connection is to be made where there is also a core or mold parting or joint line intersecting the site for the bolted connection. It should also be understood that the slope of the tapered surfaces of the core raised area and casting may generally be relatively small.

Many of the above principles can be applied to improve hollow cast metal bolsters 20 as well. As shown in FIGS.

30–31, a bolster 20 can be made with three consolidated cores defining its interior: a one-piece center core 300 and two one-piece end cores 302 supported on the center core 300. Other standard cores, such as two spring cores, four pocket cores and a top center pin core, would still be required to be used to complete the bolster.

Figures 22, 22A, 23, 23A:
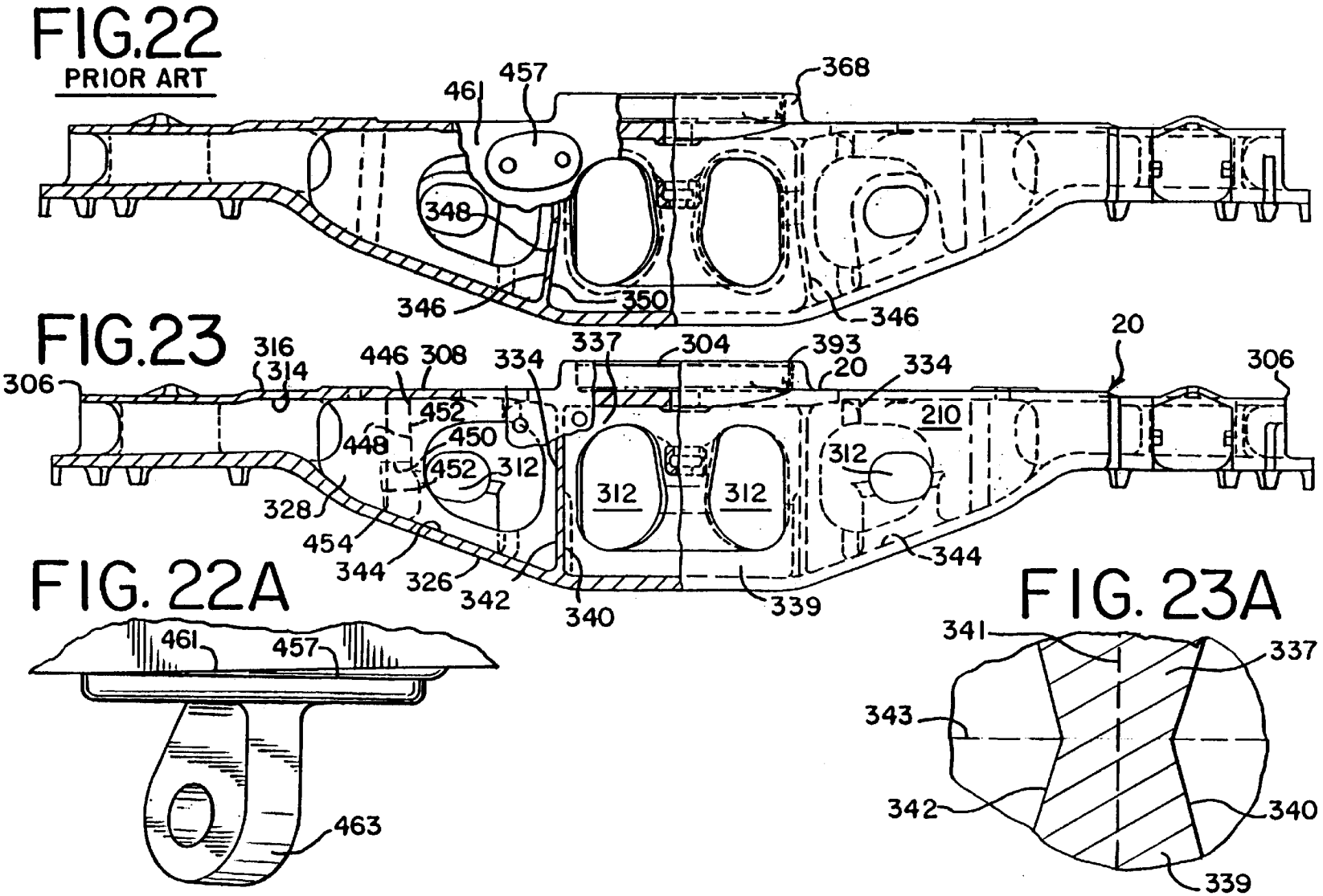
FIG.22 PRIOR ART
FIG. 22 is a side plan view of a prior art bolster, with part shown in cross-section.
FIG. 22A is a partial top plan view of the prior art bolster of FIG. 22, showing the mounting of a dead lever lug on a flat area of the bolster.
FIG. 23 is a side plan view of a bolster made according to the present invention, with part shown in cross-section.
FIG. 23A is a partial cross-section of a rib of the bolster of FIG. 23.
Figure 24:
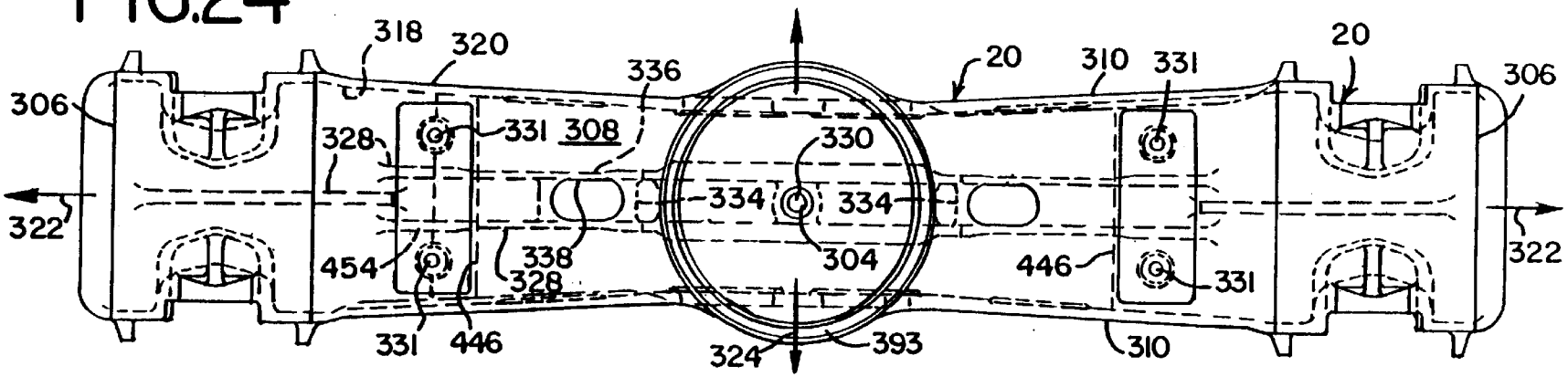
FIG. 24 is a top plan view of the bolster of FIG. 23.

The bolster 20, as shown in FIGS. 23 and 24, has a center 304, two outboard ends 306, a top wall 308, and parallel side walls 310 extending down from the top wall 308. Each illustrated side wall 310 has four large, spaced holes 312, and each hole has an overall length and width. The bolster has an interior and the top wall 308 has an interior surface 314 and an exterior surface 316. The side walls 310 also have interior surfaces 318 and exterior surfaces 320. The bolster 20 has a central longitudinal axis 322 running from one outboard end 306 to the opposite one, and a central transverse axis 324. The bolster 20 also has a bottom wall 326 and interior walls 328. The bottom wall 326 in the illustrated embodiment extends between the sidewalls 310, and can have openings or holes (not shown) communicating with the interior of the bolster.

The bolster 20 also has a center bore 330 through the top wall 308. The central longitudinal axis 322 and central transverse axis 324 intersect at the center bore 330. Two sets of bolt holes 331 are provided for mounting side bearings to the bolsters.

Within the interior of the illustrated embodiment of a bolster, there are longitudinal ribs 328 extending longitudinally between the interior surface 314 of the top wall 308 and the bottom wall 326, and transverse support ribs 334 extending transversely between the longitudinal ribs 328.

As shown in FIGS. 23–24, each longitudinal rib 328 has opposite faces 336, 338, and each transverse rib 334 has opposite faces 340, 342. In the illustrated embodiment, at least one of each pair of faces 336, 338, 340, 342 is generally perpendicular to the plane of the top wall 308 of the bolster and remains generally perpendicular to that wall throughout its entire height. Similarly, the faces 340, 342 of the illustrated transverse ribs 334 are generally parallel to the transverse axis 324 throughout their entire height, from the interior surface 314 of the top wall 308 to the interior surface 344 of the bottom wall 326. At least one of the opposite faces 336, 338 of the longitudinal ribs 328 is generally parallel to the central longitudinal axis 322 throughout its entire length. The central longitudinal axis 322 and transverse axis 324 lie in vertical planes, and at least one of the illustrated opposite faces 336, 338, 340, 342 of the longitudinal ribs 328 and transverse ribs 334 is generally vertical throughout its entire length.

Figure 28:
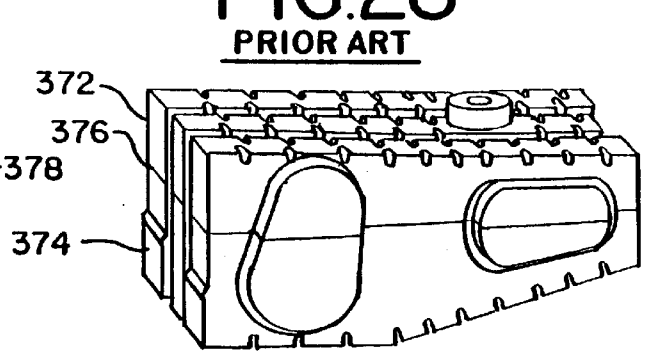
FIG.28 PRIOR ART
FIG. 28 is a perspective view of another group of prior art cores used in making the prior art bolster.

In contrast, in the prior art bolster illustrated in FIG. 22, the transverse support ribs 346 had faces 348, 350 that were both angled throughout a portion of their heights. These faces 348, 350 were both in non-vertical planes that intersected the vertical plane of the central transverse axis 324. These angled transverse ribs 346 prohibited making a one-piece center core for the bolster, since such a core could not be removed from the core box without damage to the core. Instead, multiple cores, as shown in FIG. 28, were needed to produce the central portion of the bolster.

In this aspect of the present invention, all of the interior transverse rib faces have been aligned to allow a one-piece core to be made and used without sacrificing the desired physical characteristics of the bolster. Although the interior ribs may thin or thicken between the top and bottom walls, the change is on one side of the parting line for the one piece core, and only one face of the wall changes direction on that side of the parting line. And while the interior ribs made with a one piece core may have draft faces, on each side of the parting line the faces do not diverge from a vertical plane in the same direction. Thus, as shown in FIGS. 23 and 23A, in the top portion 337 of the bolster, from the top wall 308 down, the faces 336, 338, 340, 342 of the longitudinal and transverse ribs do not diverge in the same direction from a vertical plane 341 between them and parallel to one of the longitudinal or transverse axes 322, 324, and in the bottom portion 339 of the bolster, up from the bottom wall 326 to the top portion, the faces 336, 338, 340, 342 of the longitudinal and transverse ribs do not diverge in the same direction from a vertical plane between them and parallel to one of the longitudinal or transverse axes 322, 324. The top and bottom portions 337, 339 are defined by a line 343, shown in FIG. 23A, corresponding with the parting line 406 of the center core used to make the bolster, shown in FIG. 30.

Figure 29:
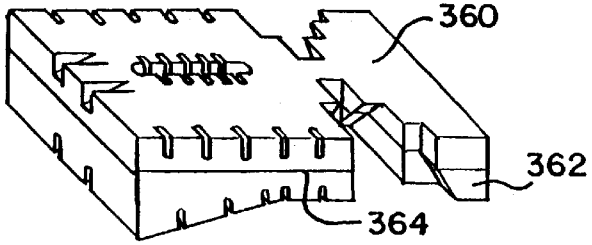
FIG.29 PRIOR ART
FIG. 29 is a perspective view of another group of prior art cores used in making the prior art bolster.
Figure 25:
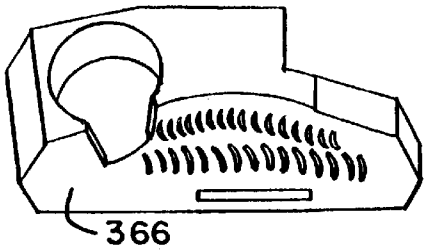
FIG.25 PRIOR ART
FIG. 25 is a perspective view of a prior art core used in making the prior art bolster.

The multiple prior art cores needed to produce a prior art bolster are illustrated in FIGS. 25–29. As shown in FIG. 29, two sets of cope and drag end cores 360, 362 were required to make the central part of the bolster, joined along a joint line 364. Right and left collar cores 366, shown in FIG. 25, were needed to form the center bowl or plate 368 (shown in FIG. 22). An additional lug core 370, shown in FIG. 26, was used to form lug holes in the side wall for attachment of a brake beam dead lever lug to the bolster. Two sets of cope 372 and drag 374 center cores, shown in FIG. 28. These center cores 372, 374 were also joined along joint lines 376. As in the case of the sideframe cores, these cores were supported on the drag mold surface by chaplets. Thus, there was a potential for shifting of the cores, and control of the thicknesses of the metal walls became problematic. In addition, with all of the joint lines, there was a potential for stress risers to form in the casting.

Figure 27:
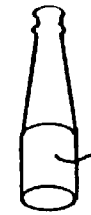
FIG.27 PRIOR ART
FIG. 27 is a perspective view of another prior art core used in making the prior art bolster.
Figure 26:
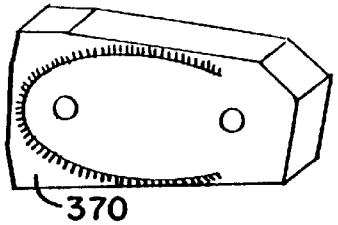
FIG.26 PRIOR ART
FIG. 26 is a perspective view of another prior art core used in making a prior art bolster.

As shown in FIG. 27, the prior art also used four separate pin cores 378 to be attached to the cope parts 360 of the end cores to form holes 331 for attachment of side bearings to the bolster. There was the potential for the pin cores 378 to be attached off-axis, creating the potential for undesirable stress on the bolts for attaching the side bearings to the bolsters.

In this aspect of the present invention, these sixteen prior art cores have been consolidated into three cores, shown in FIGS. 30–39. In both the embodiments of FIGS. 32 and 33, the one-piece center core 300 has a center core body 380 to be received in a mold cavity for defining the interior surfaces 314, 318, 344 of parts of the top 308, side 310 and bottom 326 walls of the bolster, as well as parts of the longitudinal ribs 328 and transverse ribs 334. The center core body 380 has a central longitudinal axis 382 and a central transverse axis 383, as well as outer surfaces 384 to define the interior surface 318 of the sidewalls 310. Outboard of the outer surfaces 384 are two core prints 386. The core prints 386 are integral with the center core body 380, and serve to support and position the center core in the drag mold 387 so that no support chaplets are required. The inner surfaces 455 of the core prints (FIGS. 34, 35) also serve to define a portion of the exterior surfaces 320 of the bolster sidewalls 310. Spaced surfaces 381 (FIG. 39) in the receiving mold also define portions of the exterior surfaces of these sidewalls. The core prints 386 are connected to the center core body 380 through necks or bridges 388 corresponding in size, shape and position with the holes 312 in the sidewalls.

The center core body 380 and center core prints 386 have lengths sufficient to span across the widths of all of the necks or bridges 388 on one side of the center core body. The center core prints 386 have heights sufficient to span across the heights of all the necks or bridges 388 on the center core body 380. In the illustrated embodiments, the core print heights are also great enough to extend to a pair of holes 390 (FIGS. 31–33) in the print and aligned with holes in the core body 380 to receive cylindrical cores to define the dead lever lug holes. The heights of the core prints vary with the heights of the adjacent necks or bridges across the lengths of the core prints.

As shown, each embodiment of the core prints 386 has a central zone 392 and two end zones 394. The central zone 392 and end zones 394 have stepped top surfaces 396 and stepped bottom surfaces 398, and the heights of the central zones 392 of both embodiments are greater than the heights of the end zones 394.

Figure 32:
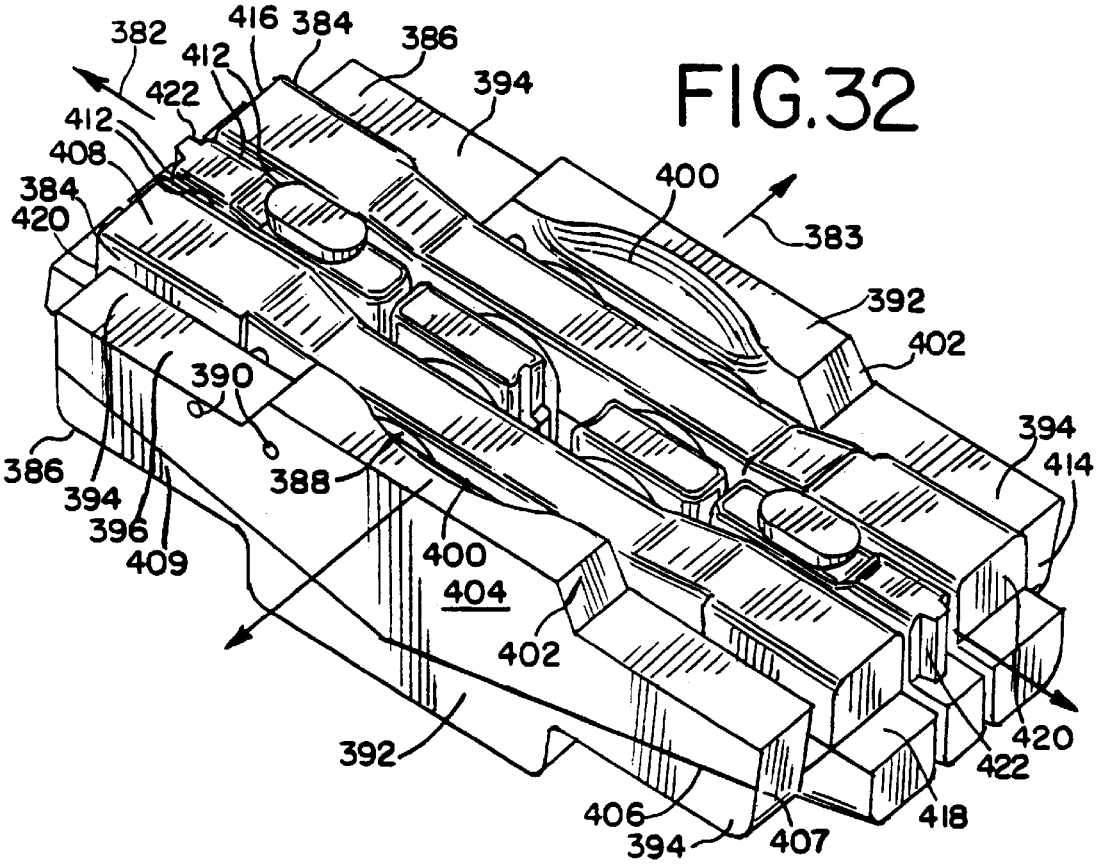
FIG. 32 is a perspective view of an embodiment of a one-piece bolster center core of the present invention.
Figure 33:
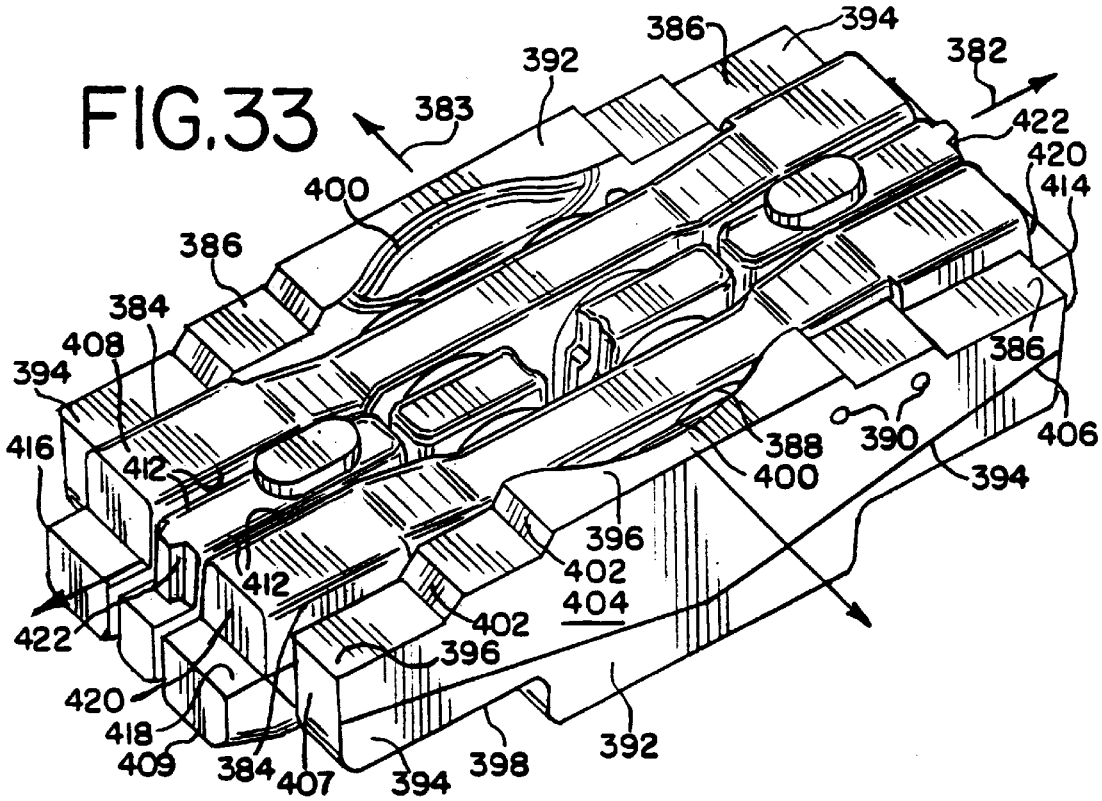
FIG. 33 is a perspective view of another embodiment of a one-piece bolster center core of the present invention.

The central zones 392 of both core prints 386 have a height great enough and are wide enough to form part of the center plate or bowl 393 (FIGS. 23, 24) of the bolster. As shown, the center plate forming parts 400 are integral with the core prints 386. At the core prints' end zones 394, the top surfaces 396 and bottom surfaces 398 are stepped toward each other, away from the top and bottom surfaces at the central zone. The top surface 396 may have also two steps, as shown in FIG. 33, or a single step as shown in FIG. 32. In either embodiment the different levels of the top and bottom surfaces may be joined by angled or draft surfaces 402 that ease removal of the bolster center core from the core box. The drag 387 and cope 403 mold surfaces are formed to have recesses that mate with the shapes of the core prints so that the core prints may be easily placed in the mold.

The bottom surfaces 398 of the core prints 386 comprise weight support surfaces parallel with the top surfaces of the core prints. The total surface areas of the two weight support surfaces of the core print and mating surfaces of the drag mold surface are great enough to support the entire center core on the drag mold surface 387 free from support chaplets. The weight support surfaces lie in planes that intersect the longitudinal axis 382 of the center core. The draft surfaces 402 of the core prints and mating surfaces of the cope mold may comprise positioning surfaces that lie in planes intersecting the top surfaces and bottom surfaces 396, 398 of the core prints. The draft surfaces 402 may thus serve to limit longitudinal movement of the core body 380 in the mold. The end faces 407 of the core prints, received against mating faces in the drag mold, may also serve to limit longitudinal movement of the center core. The outer surfaces 404 of the core print and mating surfaces in the drag mold perpendicular to the top 396, bottom 398 and draft 402 surfaces may control lateral movement of the center core with respect to the drag mold portion 387.

The one-piece center core 300 is free from joint lines, but has a parting line 406 with segments that intersect the vertical plane of the central transverse axis 382, 383. The center core body 380 has atop portion 408 on one side of the parting line 406 and a bottom portion 409 on the opposite side of the parting line 406. As shown in FIGS. 32 and 33, the parting line 406 does not intersect the end faces 407 of the core, since it is preferred that the end faces 407 not have a draft above the parting line that would create a gap in the mold. Instead, the parting line goes to the top surface 396 of the end zone at the end face 407 and then down again.

Figure 34:
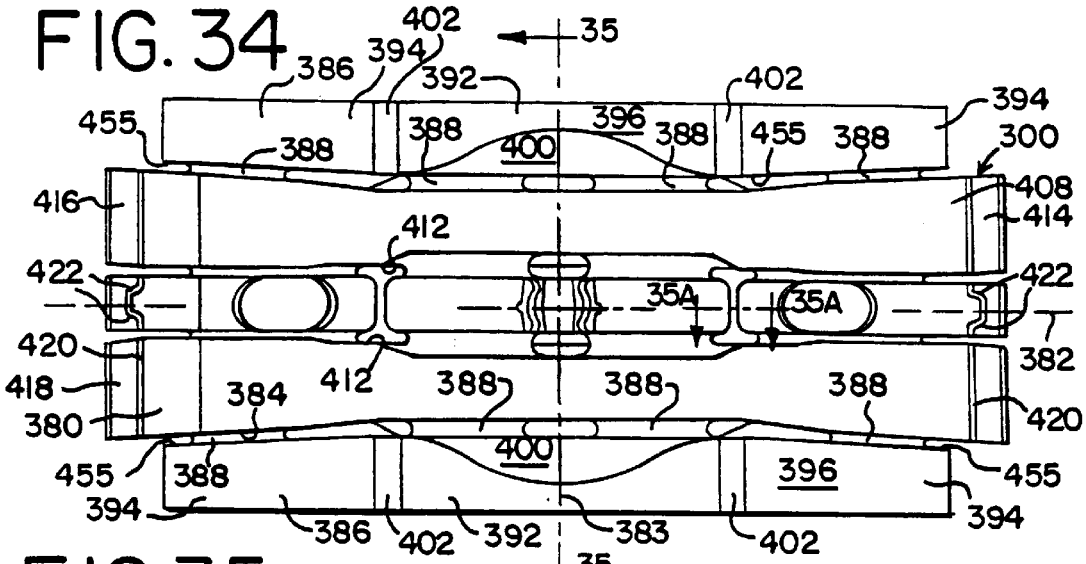
FIG. 34 is a top plan view of the bolster center core of FIG. 32.
Figure 35:
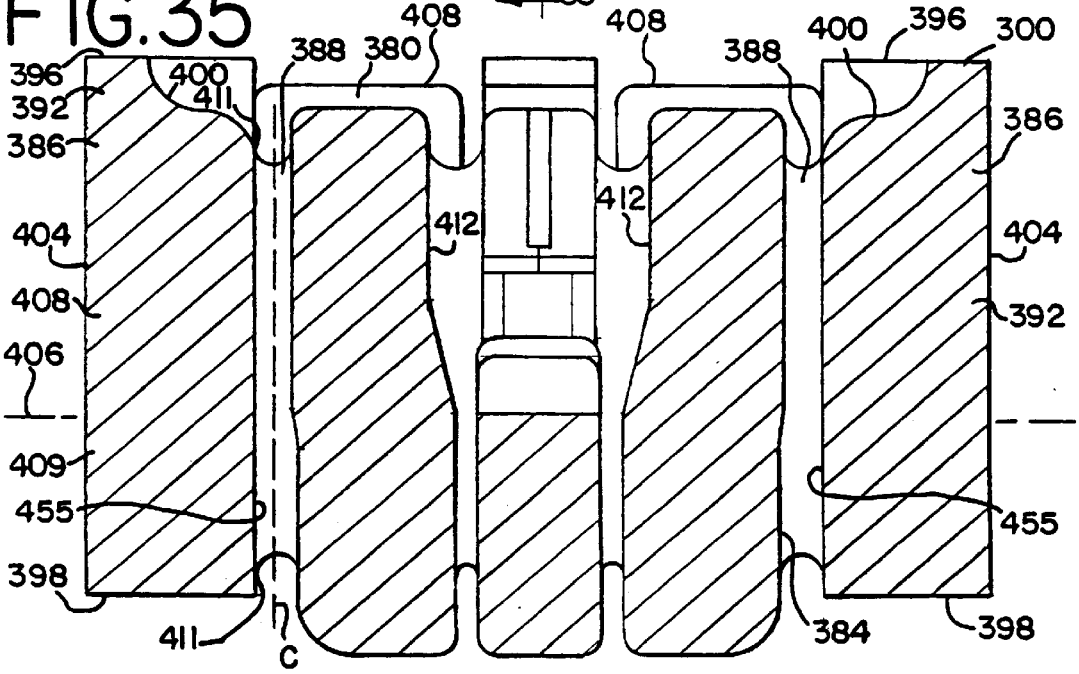
FIG. 35 is a cross-section of the bolster center core of FIG. 34, taken along line 35—35.

The center core body 380 has a plurality of interior surfaces 412, with pairs of them spaced apart to define slits for forming the longitudinal ribs 328 and transverse ribs 334 of the bolster 20. As shown in FIGS. 34 and 35, to facilitate removal of the core from the core box, no two adjacent surfaces on one side of the parting line 406 diverge from a vertical plane parallel to the transverse or longitudinal axis 382, 383 in the same direction; this design allows the core to be made in one-piece with a cope and drag core box pulled apart on the parting line 406.

Figure 35A:
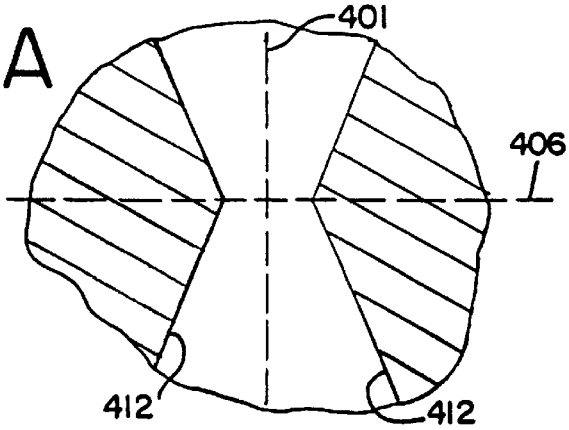
FIG. 35A is a partial cross-section along line 35A—35A of FIG. 34.

As will be understood by those in the art, the interior surfaces 412 of the bolster center core may have drafts to facilitate removal of the core from the core box. However, the core will not have back drafts that would be damaged in removing the core from the core box if, as shown in FIG. 35A, no two adjacent surfaces 412 on one side of the parting line 406 diverge in the same direction from a vertical plane 401 between them and parallel to one of the longitudinal or transverse axes 382, 383 of the core.

The necks or bridges 388 connecting the core body and the core print 386 may be concave curves, like the necks or bridges for the embodiment of the sideframe end cores illustrated in FIG. 11, so that the resulting bolster has convex surfaces at the edges surrounding the holes 312. As in the sideframe end cores, as shown in FIG. 35 the bolster core necks 388 may comprise inwardly curved surfaces with one or more centers of curvature designated "c" lying in a line around the exterior of the neck or bridge, beyond the junctures 411 of the necks and print, as in FIG. 11 embodiment for the sideframe. As in the sideframes, the thicknesses of the necks 388 correspond with the desired thickness of the walls of the cast bolster in that area. As in the sideframe, the radius of curvature may be greater than or equal to one-half the thickness of the neck or bridge. In the illustrated embodiment, the radius of curvature of the necks is less than one-half the thickness "n" of the necks, being about the sixteenths of an inch for a metal thickness of one-half inch to meet the draft adjoining draft surfaces of the core print interior 455 and core body exterior 384. As shown in FIG. 22A, prior art bolsters frequently used a flat raised mounting area 457 on the exterior of the sidewall 461 for mounting a dead lever lug 463 to the bolster. Such flat raised mounting areas have provided a level mounting for the dead lever lugs, that is, for the mounting bracket for the railcar braking mechanism, in an area where the sideframe is angled. However, to provide such a flat raised mounting area on a bolster made with a one-piece center core is problematic: to avoid creating a step which would prohibit removing the one piece core from the core box, the mounting area would have to extend to the parting line, but this would add to the weight of the casting. Instead, in the present invention, the area of the bolster sidewall 310 where the dead lever lug is to be mounted does not have a flat mounting area; the area of the bolster sidewall is instead angled, as seen in FIG. 24, and the dead lever lug is similarly angled for mounting on the bolster sidewall, as shown in FIGS. 41 and 42.

Figure 41:
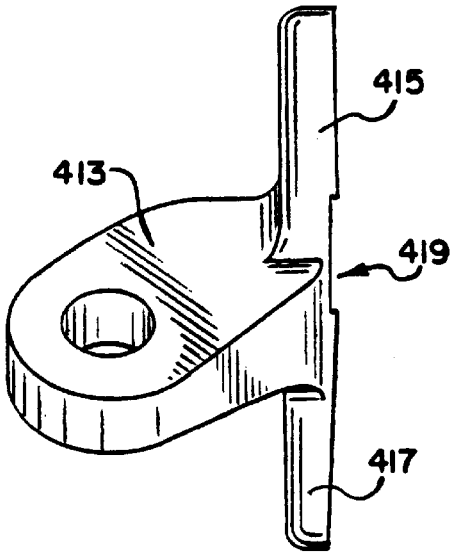
FIG. 41 is a side view of a dead lever lug that may be used with the bolster of the present invention.
Figure 42:
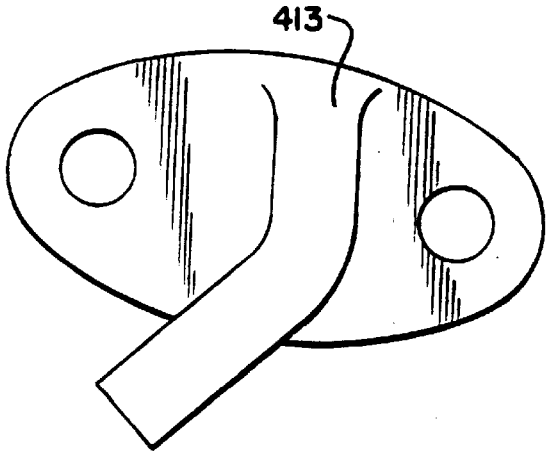
FIG. 42 is a top plan view of the dead lever lug of FIG. 41.

As shown in FIGS. 41 and 42, a dead lever lug 413 for use with the illustrated bolster has two arms 415, 417 angled to mate with the angle of the bolster sidewall. The illustrated dead lever lug arms 415, 417 are spaced apart with a gap 419 between them. The gap 419 spans the radius on the bolster sidewall where the sidewall is angled. The arms 415, 417 may also be angled in another direction to mate with any draft in the sidewall.

Figure 30:
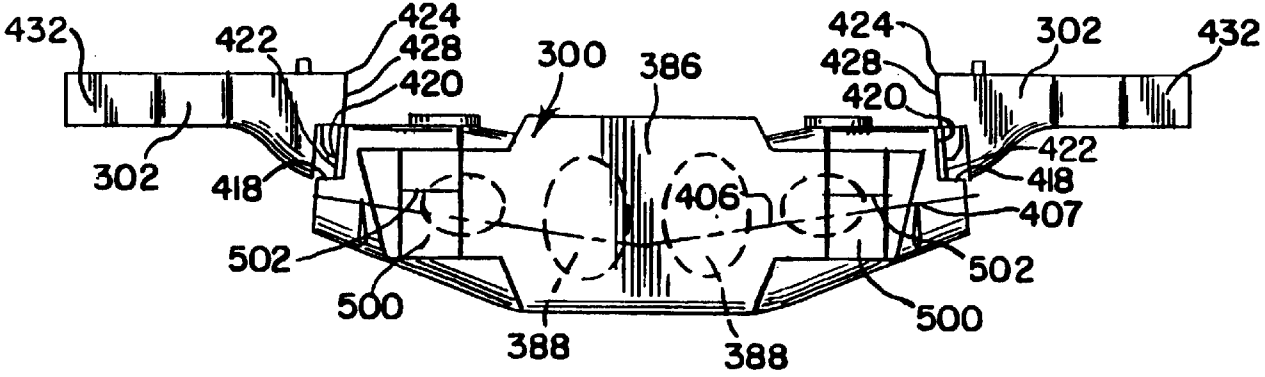
FIG. 30 is an exploded side plan view of the three one-piece bolster cores of the present invention.
Figure 36:
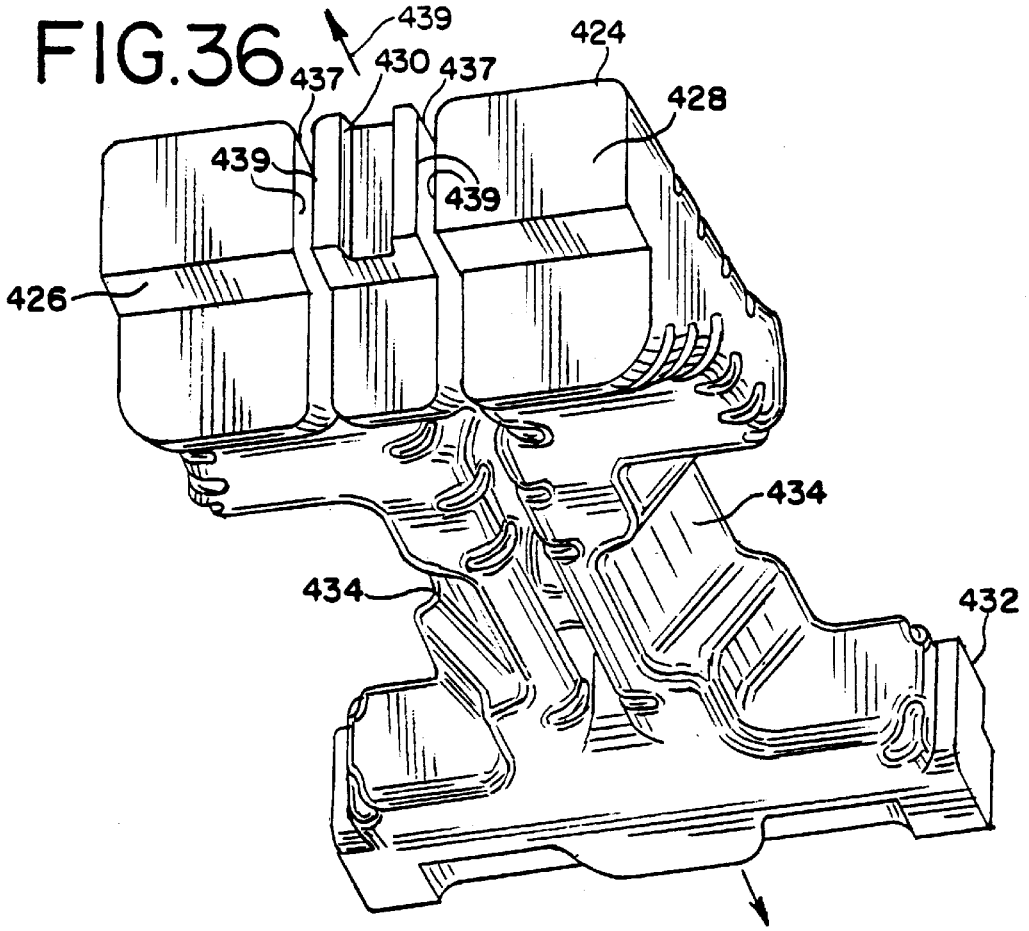
FIG. 36 is a perspective view of a one-piece bolster end core of the present invention.

In another aspect, the one-piece center core 300 for the bolster may have two stepped outboard ends 414, 416 opposite from the transverse center line 383 for supporting the end cores 302. Each of the two outboard ends 414, 416 of the bolster has a weight support member 418, a longitudinal limit member 420, and a lateral limit member 422 all lying in different planes. As shown in FIGS. 30 and 35–36, the two inboard ends 424 of the end cores 302 have mating weight support members 426, longitudinal limit members 428 and lateral limit members 430, all comprising surfaces lying in different planes. In the illustrated embodiment, the weight support members or surfaces 418, 426 are perpendicular to the planes of the longitudinal axis 382 of the core body. The mating longitudinal limit members 420, 428 lie in planes parallel to the plane of the transverse center line 383 and the mating lateral limit members 422, 430 lie in planes parallel to the longitudinal axis 382 of the core body. The mating lateral limit members 422, 430 may comprise a key at each end 414, 416 of the center core and a mating keyway in the ends 424 of the end cores, as shown in FIGS. 31–34 and 36–37.

Figure 31:
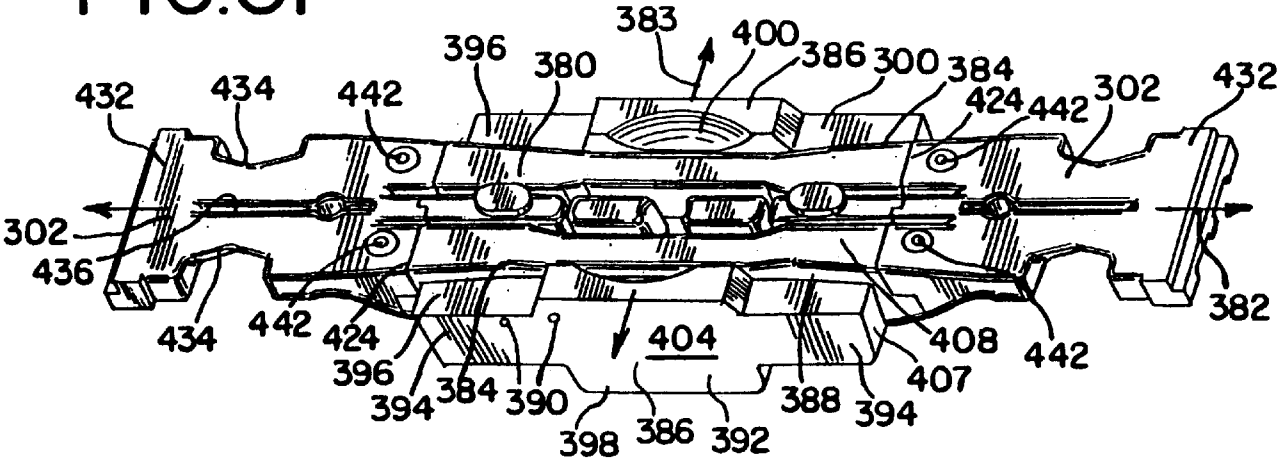
FIG. 31 is a perspective view of the three one-piece cores of the present invention with the two one-piece end cores resting on the one-piece center core.
Figure 38:
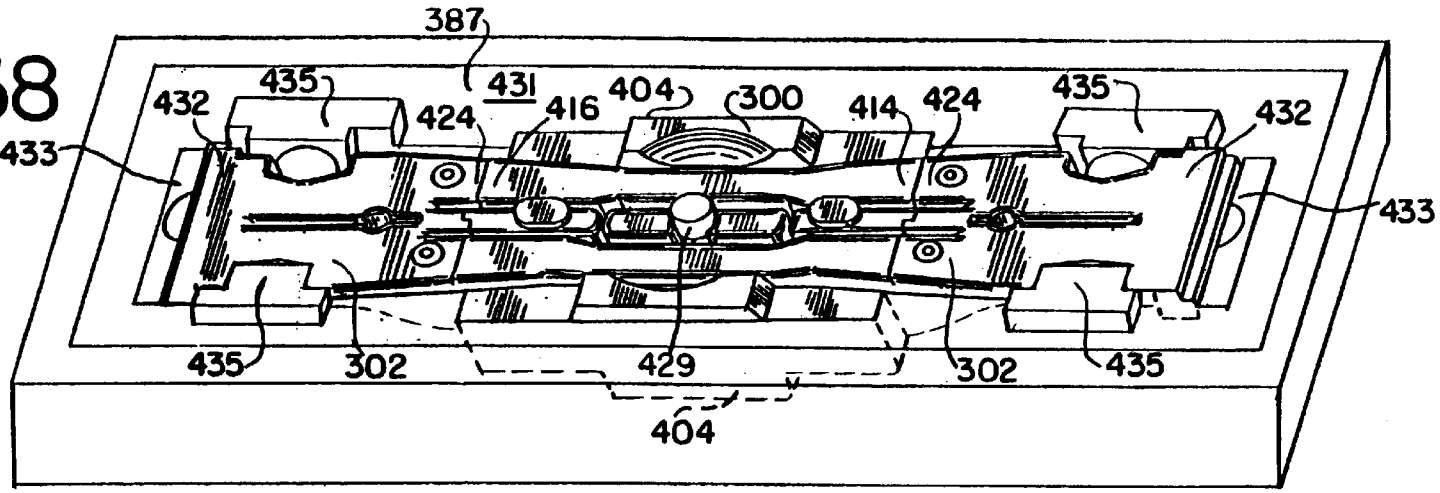
FIG. 38 is a perspective view showing the three one-piece bolster cores of the present invention in place in the drag side of a mold flask.
Figure 39:
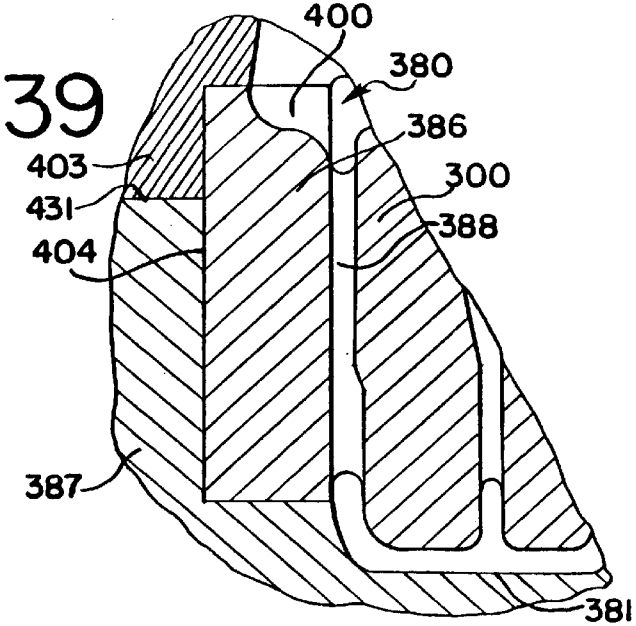
FIG. 39 is a partial cross-section showing the position of one of the cores of the present invention relative to the cope and drag parts of a mold.

As shown in FIGS. 30–31 and 38, when the three cores 300, 302 are assembled the interior or inboard ends 424 of the end cores 302 are supported by the outboard ends 414, 416 of the one-piece center core 300. Each end core 302 also has an outboard end 432 that rests on and is supported by a part of the drag mold surface 387 when the three cores are placed in a mold. The drag mold 387 and outboard ends 432 of the end cores may have mating surfaces to ensure proper placement of the cores in the mold and the cope mold may also have mating surfaces to stabilize the positions of the outboard ends 432 of the two end cores. As shown in FIG. 38, gating or gas relief cores 433 may also be provided at the outboard ends 432 of the end cores. With the end cores 302 thus supported and the center core 300 supported solely by the core prints 386, all three cores may be supported above the drag mold surface free from support chaplets. In the illustrated embodiment, the top surfaces 396 of the end zones 394 are flush with the top surface 431 of the drag mold 387 so that the bottom surface of the cope mold may bear against the end zones 396 and hold down the core.

Figure 37:
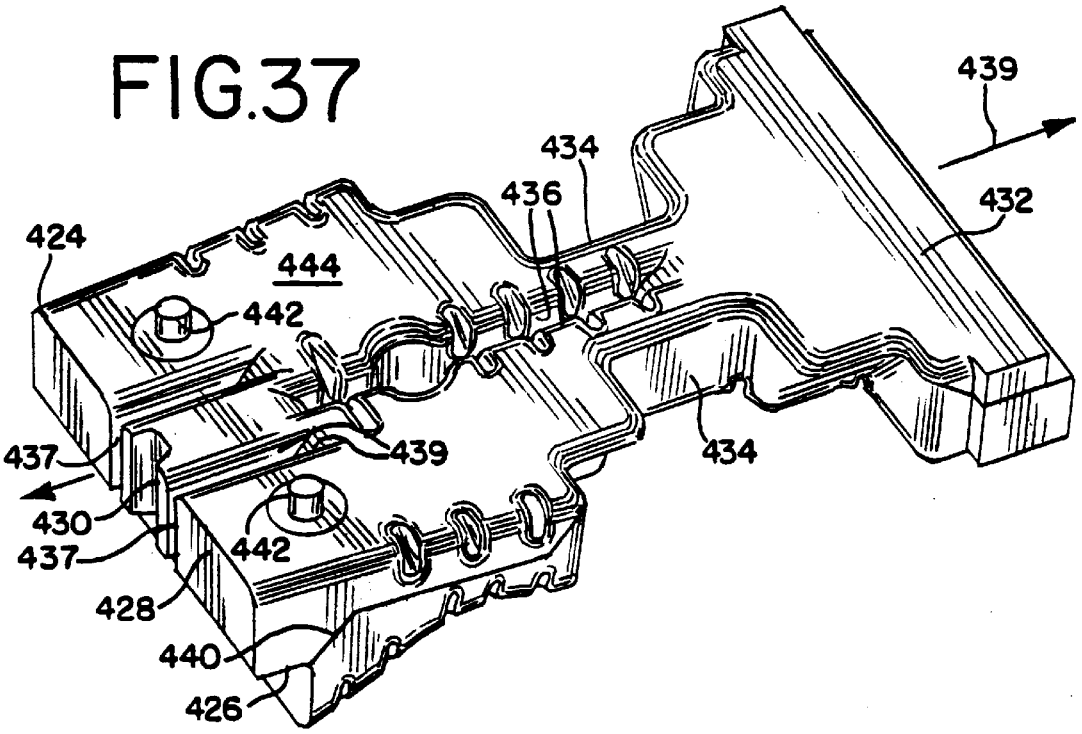
FIG. 37 is another perspective view of the one-piece bolster end core of FIG. 36.

The end cores 302 may each be a one-piece integral core free from joint lines as illustrated in FIGS. 36 and 37. The end cores may have recessed areas 434 for forming the parts of the bolsters that ride on friction shoes on the sideframes, and as will be understood by those skilled in the art, the shape of the end cores will vary with the type of friction shoe to be used. As shown in FIG. 38, mating friction shoe cores 435 may be provided on the drag mold surface. In addition, as shown in FIG. 38, a center pin core 429 may also be provided at the center of the bolster center core. In each end core, parallel interior surfaces 436 define a central slit 438 along a central longitudinal axis 439 for forming one of the longitudinal ribs 328 of the bolster. Additional slits 437 are formed by parallel surfaces 439 at the at the inboard ends 424 of the end cores 302 and align with interior surfaces 412 of the bolster center core to form two additional longitudinal ribs 328. Each end core 302 may have a parting line 440 but is free from any joint line.

Each end core 302 also has a pair of integral bolt hole cylinders 442 extending upwardly from the top surface 444 of the end core. The bolt hole cylinders are aligned transversely near the stepped inboard ends 424 of the end cores to provide the holes 331 for bolts for mounting side bearings to the bolster.

A bolster resulting from using the three cores of this aspect of the present invention can be expected to have a minimum number of interior fins or joint lines. The only interior fins or joint lines can be expected to be along the junctures of the center core 300 and end cores 302. Any such fin or joint line is referred to herein generically as a witness mark. As shown in FIG. 23, there may be a pair of top witness marks 446 on the interior surface 314 of the top wall 308, parts of the top witness marks 446 being perpendicular to the longitudinal axis 322, part matching the shape of the key and keyway, and positioned between the center bore 330 and the side bearing bolt holes 331. The interior surface 318 of each the side wall 310 may have a pair of side witness marks 448 leading from the ends of the top witness marks 446 to the bottom wall 326 interior surface 344. Each of the side witness marks 448 comprises a step-shape line having a segment 450 parallel to the top wall interior surface 314 between two segments 452 perpendicular to the top wall interior surface 314. A pair of spaced straight bottom witness marks 454 may extend across the interior surface 344 of the bottom wall 326 between the side witness marks 448 on opposite side walls. All of the witness marks correspond with the junctures of the mating ends 414, 416, 424 of the center core 300 and two end cores 302. The interior surfaces of the walls of the bolster are otherwise free from joint lines and fins. All of the walls of the bolster may be expected to be free from support chaplets, although there may be chaplets to prevent flotation of the end cores during casting, and possibly to position a center core forming the center bore 330.

The exterior sidewalls 310 of a bolster made in accordance with this part of the disclosure is defined in part by the interior surfaces 455 of the center core prints (FIGS. 34, 35) and may be expected to bear some imprint of the perimeters of the core prints 386 on the exterior surfaces 320 of the side walls 310. Thus, the elongated "plus" sign shape of the core prints 386 may be visible on the exterior of the casting as a witness mark.

The cores described above may be used to produce cast metal sideframes and bolsters by placing the cores in suitable drag molds formed of green sand or other material in the drag side of a flask. A suitable cope side of a flask may then be placed on the combination of the cores and drag flask.

For the sideframes, chaplets may be used to prevent floatation of the bottom center core and to support and locate other cores, such as the cores used to form recesses on the inboard sides of the sideframes to receive the ends of brake beams, the journal cores and other cores to cooperate with the one-piece end cores to form the complete pedestals 34. Such other cores are illustrated generally in FIG. 6, showing the four cores of the present invention in position in a drag flask; the details of the other cores are not shown, as those cores may be made and used according to the prior art.

For the bolster, the one-piece bolster center core 300 may be supported against movement in all three directions without chaplets, being supported by the mating mold halves and core prints. Each of the two bolster end cores 302 may be supported at one end by the stepped and keyed joint with the center core, and the other end supported by the drag mold. While the bolster end cores do not need support chaplets, floatation chaplets may be provided to hold the end cores down during pouring. Pouring and venting areas will be provided according to standard foundry practices.

The combinations may be handled as has been done traditionally in the art, and in fact may be moved with a reduced chance for the cores to shift position. Molten metal may be introduced as has been done in the past. After the metal has cooled, the casting may be removed from the flask, and the cores may be removed from the flask using known methods, such as by shaking the casting. The casting may then be finished, either as has been done traditionally in metal casting operations or the finishing operation may be automated since any fins will have been moved to the exterior of the casting. The present invention includes the method of making cast steel sideframes, bolsters, and other cast metal bodies in accordance with known foundry principles, using the new cores as described, and preferably without support chaplets for the one-piece cores. Standard grades of steel for such products may be used in these processes.

The cores may generally be made in accordance with standard foundry practices. Generally, cope and drag core box portions may be provided, and if automated equipment, such as a blower, is used to fill the core boxes, the cope and drag portions may be provided with a plurality of vents for air escape during filling. The sand used to make the cores may be mixed with a known binding agent. A suitable binder system is available from the Foundry Products Division, Ashland Chemical Company division of Ashland Oil, Inc. of Columbus, Ohio. The binder is sold under the trademark "ISOCURE" and comprises two resins: a first part with having phenolformadehyde polymer blended with solvents and a second part having polymeric MDI (methylene bis-phenylisocyanate). The two liquid resins cure to a solid urethane resin. Generally, the phenolic resin first part combines with the polyisocyanate second part in the presence of an amine catalyst (triethylamine) to form the solid urethane. Mixing the resins with the sand should be as recommended by the manufacturer, and should follow standard practices, taking into account the quality of the original sand, whether the sand is fresh or recycled, and other factors. The binder ratio and binder percentage may be adjusted as recommended by the manufacturer. The core boxes for producing the cores may have vents placed and sized as recommended by the manufacturer. It should be understood that the present invention is not limited to any particular binder system, nor to any particular core box design or device for introducing the sand and binder mixture into the core boxes.

Standard industry practices for introducing the mixture of sand and binder may be used, including but not limited to blowing. As will be understood by those skilled in the art, any suitable commercially available equipment may be used for introducing the mixture and curing agent, if any, as well as any improvement in presently available equipment. The equipment should be compatible with the binder system, but otherwise the selection of equipment may vary depending on desired production schedules.

For the blower device used, the blow tube size and position will vary with the core. Blow tubes may be located above the deepest and heaviest sections of the core, with blow tube diameters varying in accordance with standard practice. A blow plate for the center core 82 may have a plurality of conduits with rubber ends for introducing the sand and binder mixture into the core box. The cope and drag portions of the core boxes will have vent areas through which air may escape as the sand and binder mixture is blown into the core box and through which the catalyst gas may escape. The position, number and areas of the vents should be according to standard practice and as recommended by the manufacturers or suppliers of the binder and catalyst and blower equipment.

In making a one-piece core such as the illustrated one-piece center core 82 for the sideframe, traditional cope and drag core boxes may not produce the desired design that has recesses or protrusions that would interfere with pulling the two core box halves apart and removing the core. With such cores, it may be necessary to use a core box such as the drag portion illustrated in FIG. 40. As there shown, the core drag box 459 has movable walls 460, 462, 464 that may be moved inward during core production and then pulled outward during core removal, and a stationary wall 466 that is part of the drag. Thus, features such as the vertically-aligned cylindrical elements 164 may be formed by cylindrical recesses 468 in the movable side walls 460, 464 and pulled out of the way when the completed core is to be removed from the box. Instead of moving the entire wall, it may also be desirable to have portions that move at different times during production. The walls or portions of walls may be moved by devices such as a pneumatic control 470; in the illustrated embodiment, two pneumatic controls are provided, with lines 472 connected to power the controls 470 to move the walls 460, 462, 464 or portions of walls. Recesses in the core box walls may be provided with vents 473, and as will be understood by those in the art, any equipment used to introduce the sand and binder mixture into the core box should be designed to ensure that all parts of the core box are filled with the sand and binder mixture. Some movable parts may also be needed in producing the one-piece bolster center core with holes; axially movable cylinders may be used to produce the holes 390 through the prints and later filled with cylindrical cores.

The one-piece cores produced in accordance with the principles disclosed herein may be expected to weigh a substantial amount and accordingly be difficult for a single worker to manipulate. Accordingly, it may be desirable to provide for automation in removing the cores from the core box and in transporting the cores. In addition, pallets may be provided to support the cores. Picker fingers or lift devices may be incorporated into the core box design to lift the core out of the box, and gantries may be provided for standard moving devices to lift and move the cores. The core designs may be modified to accommodate the particular lifting and moving devices and pallets to avoid damage to the surfaces of the core bodies. For example, it may be desirable to make the core prints large enough for a lifting or supporting device to bear against several portions of the cores instead of acting against the core body itself. And it may also be desirable to provide orifices or recesses in the core prints and core bodies to receive lifting devices for moving the cores as well as to lighten the cores and reduce the amount of sand and binder required to be used. As with the lifting devices, storing and moving devices selected may vary depending on many factors, the illustrated cores may be varied to accommodate the equipment available or selected.

Examples of variations in the core design to accommodate lifting and moving devices are illustrated in FIGS. 6–8A, 14 and 30. As shown in FIG. 30, for example, each core print 386 on the bolster center core 300 may have a pair of recesses 500 defining a shelf 502 for receiving the end of a lifting device. As shown in FIGS. 6–8A and 14, the side-frame center core 82 may have an central opening 504 with an interior shelf 506 as shown in FIG. 8A; thus, a group of lifting arms 508 can be used, each rotating about its central longitudinal axis 510, with a perpendicular segment 512 that rotates to fit under the interior shelf 506 so that the core may be lifted. The lifting devices may then be rotated so that the perpendicular segments are no longer under the shelf when the core is deposited in its proper position on the drag mold, for example. Preferably, the lifting devices contact the cores in areas such as the prints to avoid harming the cores.

It should be understood that standard foundry practices should be used along with the disclosures of the present invention, such as providing chill plates where necessary for the best quality casting. It should also be understood that the illustrated cores do not necessarily show recesses to form the chill plates, and the absence of chill plates or recesses in a drawing should not be considered as a teaching that none are necessary or desirable. Similarly, where slits are shown in cores that may correspond with chill plates generally, it should be understood that the positions of the chill plates may be other than as shown, as the drawings are merely illustrative of such features.

Standard foundry practices may be used in washing and drying the cores. In accordance with standard foundry practices, various surfaces such as the longitudinal and lateral limit surfaces of the sideframe end, center and bottom center cores and bolster center and end cores, and various walls and ribs may have slight drafts incorporated into the design to facilitate removal of the cores from the core boxes.

For handling the finished cores in, for example, transferring the core from the core-making site to the site where the cores are placed in the mold, it may be desirable to provide pallets that are capable of supporting the combined cores.

While only specific embodiments of the invention have been described and shown, it is apparent that various alternatives and modifications can be made thereto. For example, although the cores have been shown shaped to produce particular railway truck parts, it should be understood that changes in shapes may be made for other types of railway trucks, and the invention is not limited to the illustrated style of railway truck. In addition, although the invention has been described with respect to particular core structures for producing railcar truck parts, the principles of the invention may be applied to the production of other cast metal structures. It is, therefore, the intention in the appended claims to cover all such modifications and alternatives as may fall within the true scope of the invention.

We claim:

1. In a metal body, cast in a mold, around a core having a line, the cast metal body having a wall with two faces, one of the faces being an interior face formed against the core along the core line, the wall having a bolt hole through the faces at the core line for connecting the cast metal body to another body, the improvement wherein the cast metal body has an edge on the surface of the interior face, and a depression in the interior face, the depression having a center surrounded by the edge and a tapered surface extending inward from the edge toward the center, the bolt hole being at the center of the depression.

2. The metal body of claim 1 further comprising an element connected to the metal body through a bolt extending through the bolt hole, a nut and an annular washer through which the bolt extend, the annular washer having an outer edge bearing against the tapered surface of the depression, the nut bearing against the annular washer.

3. The metal body of claim 1 wherein the core line comprises a parting line and wherein the tapered surface of the depression extends over and on both sides of the parting line.

4. A cast metal sideframe for a railway car truck of the type supported on a pair of wheelsets extending between two sideframes and a bolster extending between and supported by the sideframes, the sideframe including a front end, a rear end, a top member and a tension member, columns extending on the sides of a bolster opening in the middle of the sideframe between the top member and tension member, the columns including walls with exterior faces and interior faces with bolt holes extending through the walls, the interior faces of the columns including depressions surrounding the bolt holes, the depressions comprising tapered surfaces extending from a deepest point nearest the exterior face toward the interior face.

5. The cast metal sideframe of claim 4 further comprising a wear plate attached to the exterior face of each column, a bolt extending through the wear plate and bolt hole to an interior end in the interior of the sideframe, a nut and an annular washer on the interior end of the bolt, the annular washer having an outer edge bearing against the tapered surface of the depression.

6. The cast metal sideframe of claim 4 wherein the exterior faces of the columns are nearest the bolster opening, and wherein each depression is widest at the interior face of the columns and narrowest at the deepest point nearest to the nearest exterior column face.

* * * * *